US010033138B2

(12) United States Patent
Pierce-Jones

(10) Patent No.: US 10,033,138 B2
(45) Date of Patent: Jul. 24, 2018

(54) EXPLOSION PROOF CONNECTOR

(71) Applicant: Trolex Limited, Stockport (GB)

(72) Inventor: John Pierce-Jones, Stockport (GB)

(73) Assignee: TROLEX LIMITED, Stockport (GB)

( * ) Notice: Subject to any disclaimer, the term of this patent is extended or adjusted under 35 U.S.C. 154(b) by 0 days.

(21) Appl. No.: 15/552,424

(22) PCT Filed: Jan. 20, 2016

(86) PCT No.: PCT/GB2016/050121

§ 371 (c)(1),
(2) Date: Aug. 21, 2017

(87) PCT Pub. No.: WO2016/132094

PCT Pub. Date: Aug. 25, 2016

(65) Prior Publication Data

US 2018/0034202 A1 Feb. 1, 2018

(30) Foreign Application Priority Data

Feb. 20, 2015 (GB) ..... 1502871.5

(51) Int. Cl.
*H01R 13/62* (2006.01)
*H01R 13/625* (2006.01)
*H01R 13/703* (2006.01)

(52) U.S. Cl.
CPC ..... *H01R 13/625* (2013.01); *H01R 13/7036* (2013.01)

(58) Field of Classification Search
CPC .... H01R 13/62; H01R 13/625; H01R 13/703; H01R 13/7036

(Continued)

(56) References Cited

U.S. PATENT DOCUMENTS 7,285,003 B2 * 10/2007 Cairns ..... H01R 13/521 439/353
2007/0155248 A1 7/2007 Cairns et al.

FOREIGN PATENT DOCUMENTS

CN 2626079 7/2004
CN 203589394 5/2014

(Continued)

OTHER PUBLICATIONS

Search Report from the United Kingdom Intellectual Property Office for Application No. GB1601089.4 dated Jul. 11, 2016 (4 pages).

(Continued)

*Primary Examiner* — Khiem Nguyen
(74) *Attorney, Agent, or Firm* — Michael Best & Friedrich LLP

(57) ABSTRACT

A pair of connectors comprises a first connector with a first contact and a second connector with a second contact. The connectors are configured for attachment to one another along an attachment axis. The connectors are movable relative to one another between a first configuration and a third configuration via a second configuration. The connectors are attached to one another in the first configuration and in the second configuration, and can only be detached from one another from the third configuration. The contacts of the connectors are touching in the first configuration, and are not touching in the second configuration. Movement of the connectors between the first and second configurations requires the connectors to undergo a first manipulation. Movement of the connectors between the second and third configurations requires the connectors to undergo a second manipulation which is different to the first manipulation.

20 Claims, 12 Drawing Sheets

(58) Field of Classification Search
USPC ..... 439/181, 187, 312
See application file for complete search history.

(56) References Cited

FOREIGN PATENT DOCUMENTS

| | | |
|---|---|---|
| CN | 104678508 | 6/2015 |
| WO | 9326062 | 12/1993 |
| WO | 0046884 | 8/2000 |
| WO | 2007071968 | 6/2007 |

OTHER PUBLICATIONS

International Search Report for Application No. PCT/GB2016/050121 dated Apr. 12, 2016 (2 pages).

* cited by examiner

EXPLOSION PROOF CONNECTOR

The present invention relates to a pair of connectors and has particular, but not exclusive, application to connectors which are suitable for use in environments where flammable or explosive materials may be present.

In some environments, the use of conventional connectors such as simple plug and socket arrangements may pose a safety risk if the connectors are positioned in an environment within which explosive or flammable substances may be present (such as flammable gasses in mines, or fine powdered ingredients in food processing plants). For example, when disconnecting the connectors, a spark may jump between the connectors' respective contacts at the point of separation of the contacts, when they are almost but are not quite touching. This spark may ignite the explosive or flammable substance in the surrounding environment, causing a fire or an explosion. Connectors for use in such environments, commonly called 'explosion proof connectors', are therefore provided with safety features to prevent sparks and the like (or hot gas from a fire or explosion within the connector that has been ignited by such a spark) from coming into contact with the environment around the connector.

The above problem is particularly prevalent in relation to relatively high voltage connectors such as those through which the power supply runs to an electrical tool or machine. However, the problem also exists with respect to lower voltage electrical connectors, such as those through which electrical data signals are passed, (e.g. USB or Ethernet connectors). Although data connectors do not generally carry any significant risk of sparking, they are rarely certified as being intrinsically safe, meaning that in many jurisdictions the law nonetheless requires steps to be taken to prevent any potential spark from casing a fire or explosion.

Further, explosion proof connectors are being used increasingly for optical data connectors. Recent legislation has set out limits governing the amount of optical power that can be exposed in a hazardous area, so as to avoid the possibility of optical ignition/detonation of materials around the connectors. Accordingly, where the power that may be released by optical connectors exceeds this threshold then the connectors must include means to isolate that power (or a fire or explosion caused by that power) from the external environment.

Still further, even where connectors are certified as being intrinsically safe, meaning that there is zero risk of sparking or exposure of above-threshold optical power, connectors are often positioned at a boundary between a safe and an unsafe environment. For instance, one of a pair of connectors can often be found in an 'Ex d' explosion proof enclosure which is used to house electrical apparatus in potentially flammable or explosive environments. In such cases the connector must be capable of maintaining the integrity of the enclosure even if the connector itself is not deemed to present an ignition/detonation risk. For this reason, even intrinsically safe connectors often take the form of explosion proof connectors, since these connectors are sufficiently robust to maintain the integrity of the enclosure. In particular, a connector may be certified explosion proof when fitted to an existing Ex d enclosure.

Conventionally, explosion proof connectors are attached to one another through respective threaded members which are screwed together to join the connectors, as discussed in more detail below. However, screw threads are relatively fragile, and screwing/unscrewing connectors can be a relatively slow and awkward action to perform; particularly, for example, when using gloves.

It is one object of the present invention to mitigate or obviate one of the aforesaid disadvantages, and/or to provide an improved or alternative pair of connectors.

According to a first aspect of the present invention there is provided a pair of connectors comprising a first connector with a first contact and a second connector with a second contact, the connectors being configured for attachment to one another along an attachment axis, wherein:

- the connectors are movable relative to one another between a first configuration and a third configuration via a second configuration;
- the connectors are attached to one another in the first configuration and in the second configuration, and can only be detached from one another from the third configuration;
- the contacts of the connectors are touching in the first configuration, and are not touching in the second configuration;
- movement of the connectors between the first and second configurations requires the connectors to undergo a first manipulation; and
- movement of the connectors between the second and third configurations requires the connectors to undergo a second manipulation which is different to the first manipulation.

One manipulation being required to move the connectors between the first and second configurations (so as to move the contacts between touching and non-touching positions) and a different manipulation being required to move the connectors between the second and third configurations (so as to move the connectors between a position in which they are retained and a position in which they can be released from one another) may allow a user to be aware of the relative positions of the connectors (for instance whether or not their respective contacts are touching) based on what manipulations have or have not been performed. Furthermore, this may allow a simpler, more rugged and/or easier to operate attachment mechanism to be utilised.

Reference to the connectors moving between the first and second configurations may refer to the connectors moving from the first configuration to the second configuration, and/or the connectors moving from the second configuration to the first configuration. In other words, moving the connectors in only one direction between the first and second configurations may require the first manipulation, or moving the connectors in each direction between the first and second configurations may require the first manipulation.

The contacts may be electrical contacts, i.e. elements which are arranged to touch one another so as to transmit an electrical current (such as a drive current for an electrical machine, or an electrical data signal) therebetween. As one alternative, the contacts may be optical contacts, i.e. elements which are arranged to touch one another so as to transmit light (for instance a visible light or infrared optical data signal) therebetween.

In some embodiments, each connector may have more than one contact. In such cases, the contacts of the first aspect of the invention may be considered to be any specific mutually co-operative pair of contacts within the connectors. With the connectors in the second configuration that pair of contacts are no longer touching, but other contacts (for instance contacts where the potential voltage therebetween is too low for sparking to occur) may still be touching.

Alternatively, all pairs of contacts may be touching in the first configuration and not touching in the second configuration.

The first and/or second manipulations may be performed by hand by a user, or may be performed by a machine.

The connectors may be provided with respective attachment portions, the first manipulation including relative movement of the attachment portions in a first direction and the second manipulation including relative movement of the attachment portions in a second direction which is different to the first direction.

Alternatively or in addition, the first and/or second manipulation may include pressing a button, releasing a latch or the like.

The first and second manipulations being relative movements of the attachment portions of the first and second connectors may allow those manipulations to be carried out with advantageous simplicity and reliability.

The relative movement may involve moving the attachment portion of the first connector while holding the attachment portion of the second connector stationary, moving the second connector while holding the first connector stationary, or moving the first and second connectors simultaneously.

The movement of the attachment portions of the connectors may or may not be relative movement of the entire connectors.

The attachment portion of the first connector may define a guideway and the attachment portion of the second connector may define a lug that is receivable in the guideway, the first manipulation including movement of the lug along the guideway in a first direction and the second manipulation including movement of the lug along the guideway in a second direction.

The use of a lug that is receivable in a guideway may provide a mechanism for attaching the first and second connectors which is advantageously rugged and/or fast or simple to operate.

The lug may move within a stationary guideway, the guideway may move around a stationary lug, or both the lug and the guideway may move at the same time.

Optionally:

- the guideway comprises a disconnection section, an intermediate section and a release section, each section having two ends, one end of the intermediate section intersecting an end of the disconnection section and the other end of the intermediate section intersecting an end of the release section;
- movement of the connectors from the first configuration to the second configuration requires movement of the lug along the disconnection section, from the end of the disconnection section which does not intersect the intermediate section to the end of the disconnection section which does intersect the intermediate section; and
- movement of the connectors from the second configuration to the third configuration requires movement of the lug along the intermediate section, from the end of the intermediate section which intersects the disconnection section to the end of the intermediate section which intersects the release section.

One or more of the disconnection section, the intermediate section and the release section may be elongate.

The connectors may also be movable from the first configuration to a fourth configuration, wherein movement of the connectors between the first and fourth configurations requires the connectors to undergo a third manipulation which is different to the first manipulation.

The connectors being movable to the fourth configuration may be used to secure them in place so that they are not inadvertently moved from the first configuration to the second configuration (whereupon the contacts of the connectors cease to touch and any electrical information or current travelling therebetween is interrupted). By providing a fourth configuration, for the connectors to be inadvertently moved towards the second configuration they would first have to be inadvertently moved to the first configuration, therefore two different manipulations (the third manipulation and the first manipulation) would have to be inadvertently performed before the contacts of the connectors would be inadvertently separated.

Reference to moving the connectors between the first and fourth configurations should be interpreted in the same fashion as reference to moving the connectors between the first and second configurations or between the second and third configurations.

The third manipulation may be the same manipulation as the second manipulation, or the first, second and third manipulations may all be different.

Optionally:

- the guideway further comprises a locking section which has two ends, an end of the locking section intersecting the end of the disconnection section which does not intersect the intermediate section;
- movement of the connectors from the first configuration to the fourth configuration requires movement of the lug along the locking section, from the end of the locking section which intersects the disconnection section to the end of the locking section which does not intersect the disconnection section.

The connectors being movable to the fourth configuration by moving the lug within the guideway may provide a mechanism which is advantageously rugged, simple or easy to operate, as outlined above.

The locking section may comprise a recess, and one of the connectors may comprise a resilient element arranged to urge the lug into said recess when the connectors are in the fourth configuration.

The lug being urged into the recess by the resilient element may provide a force biasing the lug to remain in that recess, reducing the risk of the lug being inadvertently displaced therefrom, whereupon the connectors could move towards the first configuration and be more susceptible to being disconnected by a knock.

The resilient element may take any suitable form. For instance, it may be a spring such as a coil spring, volute spring or leaf spring, or it may be an elastomeric block. The resilient element may urge the lug into the recess directly or indirectly.

The locking section may be aligned in a substantially circumferential direction about the attachment axis.

The disconnection section may be aligned in a direction substantially parallel to the attachment axis The intermediate section may be aligned in a substantially circumferential direction about the attachment axis.

The release section may be aligned in a direction substantially parallel to the attachment axis.

The attachment portion of one of the connectors may comprise a sleeve which is movable relative to a main body of that connector.

The pair of connectors may further comprise one or more markings to indicate the position of the sleeve relative to the main body.

Markings indicating the position of the sleeve relative to the main body may assist the user in determining the configuration in which the first and second connectors are positioned.

The pair of connectors may further comprise one or more markings arranged to indicate the position of the sleeve relative to the connector which does not comprise the sleeve. For instance, where the first connector comprises the sleeve, one or more markings may be arranged to indicate the position of the sleeve relative to the second connector. Conversely, where the second connector comprises the sleeve, one or more markings may be arranged to indicate the position of the sleeve relative to the first connector.

Markings indicating the position of the sleeve relative to the connector which does not comprise the sleeve may assist the user in determining the configuration in which the first and second connectors are positioned.

The lug may extend substantially radially inwards towards the attachment axis.

The lug extending substantially radially inwards may be advantageous in that the lug may be less likely to be subjected to knocks than if it projected outwardly, thereby allowing the mechanism for attaching the first and second connectors to be more rugged.

The attachment portion of the first connector may define first and second guideways and the attachment portion of the second connector may comprise first and second lugs.

The presence of two lugs and two guideways may reduce the loading experienced by a single lug and guideway, reducing the risk of damage. Furthermore, spacing the two lugs and the two guideways apart from one another can allow any load applied between the connectors (and transmitted by the lugs and guideways) to be more balanced about the attachment axis, which may reduce the susceptibility of the connectors to damage resulting from such a load.

The attachment portions of the first and second connectors may comprise three, four or more lugs and guideways respectively. Where the connectors comprise more than one lug and guideway, the lugs and guideways may be spaced substantially evenly around the attachment axis, or may be distributed in any other suitable fashion. For instance, where a pair of connectors has two lugs and two guideways, the lugs and the guideways may be positioned at substantially diametrically opposed positions about the attachment axis.

At least one of said connectors may be configured for attachment to an electrical cable or an optical cable.

The electrical cable may comprise any number of electrical wires (whether single-core or multi-core), including a single electrical wire. The optical cable may comprise any suitable number of optical fibres in any suitable configuration.

Alternatively or in addition, at least one of said connectors may be configured for attachment to a casing of an electrical unit, such as a sensor assembly or a sensor output display screen.

In the second configuration, the connectors may cooperatively define a chamber and a flame path of a predetermined length which runs from the chamber to an external surface of at least one of the connectors, the predetermined length of the flame path conforming to British Standard BS EN 60079-1:2007.

The flame path conforming to British Standard BS EN 60079-1:2007 may prevent any explosion or fire occurring within the connectors (when in the second configuration) from propagating to the environment surrounding the connectors. For example, by conforming to the above standard the flame path will be of sufficient length that any hot gases ejected along the flame path as a result of a fire or explosion within the connectors have cooled sufficiently by the time they exit the flame path that they are no longer hot enough to ignite any flammable or explosive material (for instance a flammable gas or fine powder) surrounding the connectors.

Where the connectors are of conventional size, the predetermined length of the flame path may be at least 10 mm. Alternatively or in addition, for the sake of compactness the flame path may be less than 30 mm, for instance less than 20 mm or less than 15 mm.

The flame path may be straight, or may have any other suitable configuration.

In the second configuration, the connectors may be configured to resist axial separation along the attachment axis.

The connectors being configured to resist axial separation along the attachment axis when in the second configuration may allow a flame path of sufficient length to be maintained even in the event that a fire or explosion within the connectors urges them apart from the second configuration.

One of the first or second connectors may comprise a stop surface positioned to contact a part of the first and second connectors, so as to resist axial separation of the connectors from the second configuration. For example, where the connectors comprise a lug and a guideway, the stop surface may be provided on a wall of the guideway and may contact the lug. For instance, the stop surface may be provided on a wall which defines the intermediate section of the guideway.

According to a second aspect of the present invention there is provided a first connector for a pair of connectors according to the first aspect of the invention.

According to a third aspect of the present invention there is provided a second connector for a pair of connectors according to the first aspect of the invention.

According to a fourth aspect of the present invention there is provided an electrical system comprising a first connector according to the second aspect of the invention, a second connector according to the third aspect of the invention, and/or a pair of connectors according to the first aspect of the invention.

According to a fifth aspect of the present invention there is provided a pair of connectors comprising a first connector with a first contact and a second connector with a second contact, the connectors being configured for attachment to one another along an attachment axis, wherein:

- the first connector has an attachment portion which defines a guideway, and the second connector has an attachment portion which defines a lug that is receivable in the guideway;
- the guideway comprises a disconnection section, an intermediate section and a release section, each section having two ends, one end of the intermediate section intersecting an end of the disconnection section and the other end of the intermediate section intersecting an end of the release section;
- the connectors are movable between a first configuration in which the lug is received in the end of the disconnection section which does not intersect the intermediate section, a second configuration in which the lug is received at the point at which the disconnection section intersects the intermediate section, and a third configuration in which the lug is received at the point at which the intermediate section intersects the release section;
- the contacts are touching when the connectors are in the first configuration, and are not touching when the connectors are in the second configuration;

the intermediate section is configured such that the lug can travel between the end of the intermediate section that intersects the disconnection section and the end that intersects the release section, only upon relative movement of the attachment portions of the connectors, transverse to the attachment axis, by an external force; and the end of the release section which is opposite to the end that intersects the restraint section provides a mouth through which the lug can exit the guideway.

As discussed above in respect of the first aspect of the invention, the presence of a lug that is receivable in a guideway may provide the connectors with a mechanism for attaching them to one another which is advantageously simple, rugged and/or quick or easy to operate.

For the avoidance of doubt, applying the external force to move the attachment portions of the connectors relative to one another transverse to the attachment axis may constitute a first manipulation within the meaning of the first aspect of the invention.

The relative movement of the attachment portions of the connectors transverse to the attachment axis may include relative rotation about the attachment axis, pivoting motion in a plane which is non-perpendicular to the attachment axis, and/or lateral translational motion. For the avoidance of doubt, reference to relative movement of the attachment portions transverse to attachment axis being required for the lug to travel between the ends of the intermediate section is not intended to imply that movement parallel to the attachment axis cannot not take place as well. It merely requires a component of the relative motion of the attachment portions to be in a direction which is perpendicular to the attachment axis.

Reference to the lug travelling between the two ends of the intermediate section should be interpreted in the same manner as reference to the connectors moving between the first and second configurations, as outlined above.

A pair of connectors according to the fifth aspect of the invention may have one or more of the optional or features of the first aspect of the invention. For instance, in the fifth aspect of the invention the connectors may also be movable from the first configuration to a fourth configuration, wherein the connectors can move from the first configuration to the fourth configuration only upon relative movement of the attachment portions of the connectors transverse to the attachment axis by an external force.

Where the contacts of the first and second connectors are electrical contacts, reference herein to the contacts 'almost but not quite touching' is intended to refer to the contacts being spaced apart (at their closest points) by a distance no larger than the maximum distance over which a spark may be produced between the contacts, that maximum distance being related to the maximum electric potential difference which may exist between the two contacts. The contacts almost but not quite touching may therefore be considered to refer to the contacts being spaced apart (at their closest points) by a small distance. In conventional applications, this small distance may be less than around 5 mm, for instance between around 3 mm and around 2 mm.

Specific embodiments of the present invention will now be described with reference to the accompanying drawings, in which.

Figure 1:
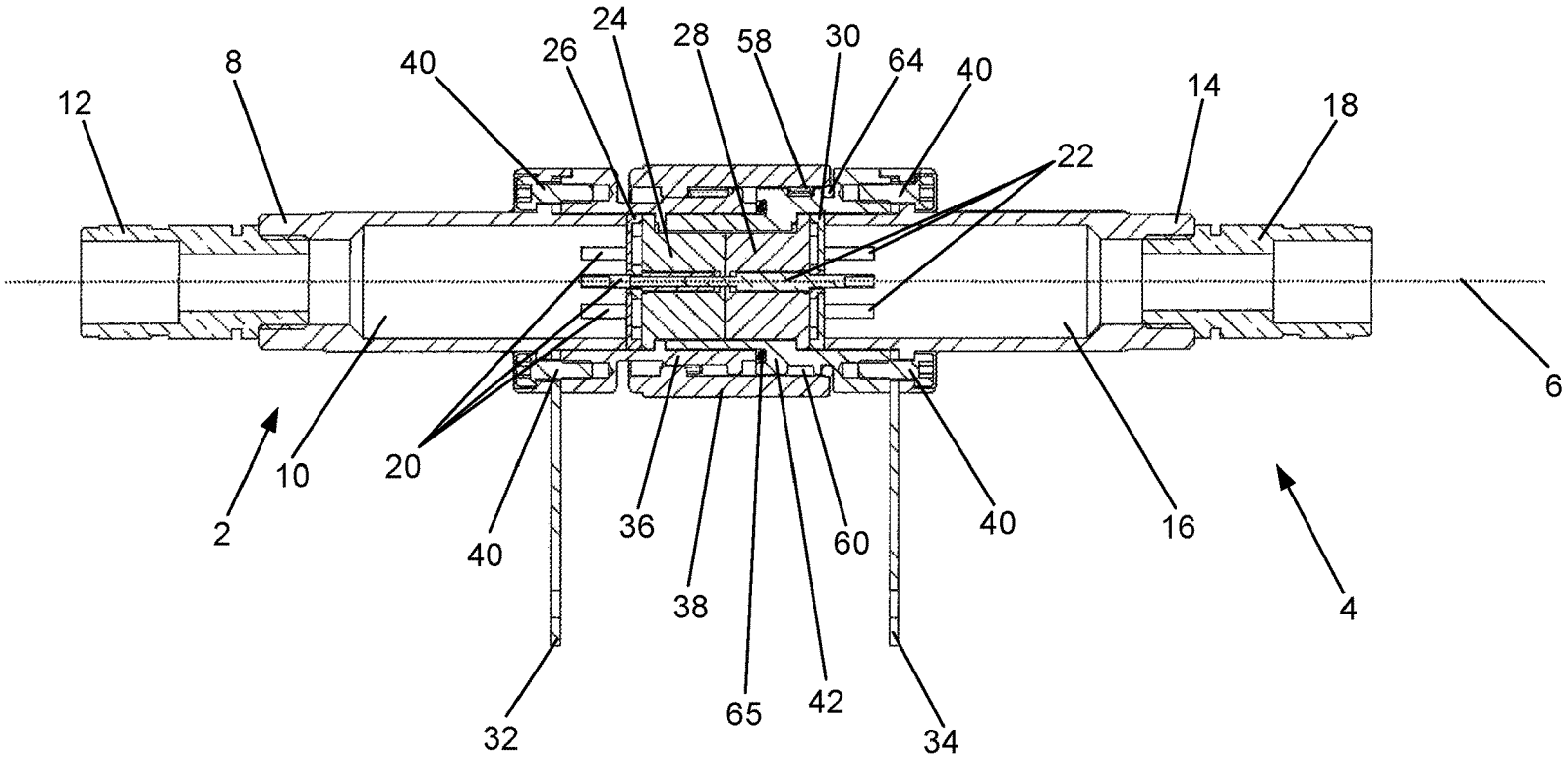
FIG. 1 is a cross-sectional side view of a pair of connectors according to a first embodiment of the invention, with the connectors in a connected configuration.
Figure 13:
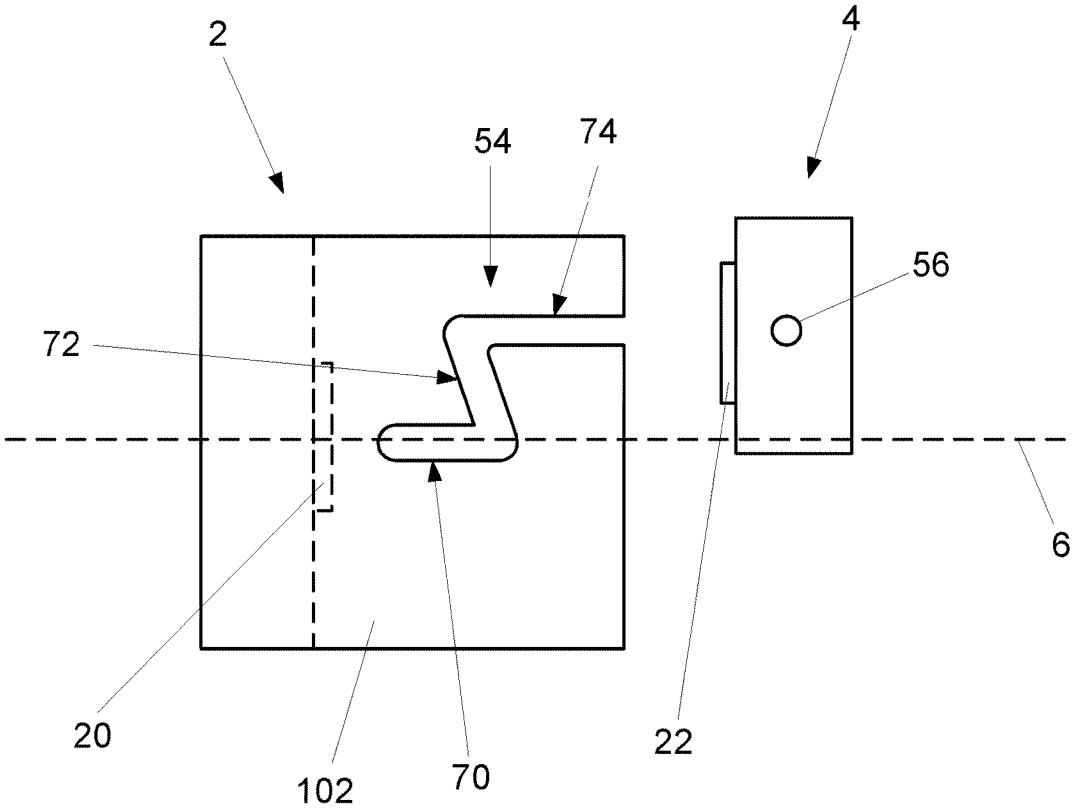
Figure 14:
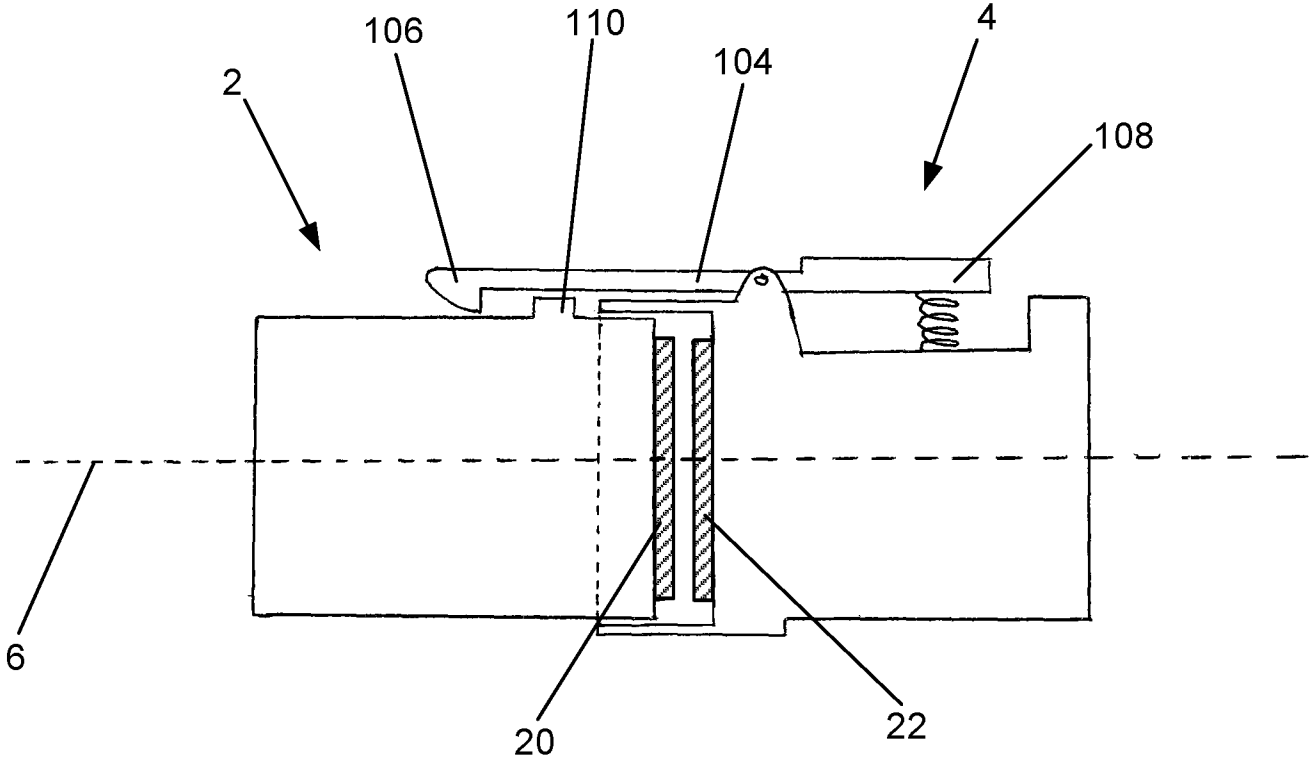

FIG. 13 is a schematic illustration of a pair of connectors according to a third embodiment of the invention; and FIG. 14 is a schematic illustration of a pair of connectors according to a fourth embodiment of the invention FIG. 1 shows a pair of connectors according to an embodiment of the invention. The pair of connectors comprises a first connector 2 and a second connector 4 for attachment to one another along an attachment axis 6. FIG. 1 shows the connectors 2, 4 attached to one another. Although each connector 2, 4 of FIG. 1 is elongate and extends along the attachment axis 6 (when the connectors are attached together), in other embodiments this may not be the case. For example, one or both of the connectors may not be elongate, or may be elongate but not aligned with the attachment axis.

The first connector 2 has a main body 8 which defines a cavity 10 for the receipt of an end of an electrical cable (not shown). The first connector 2 and the electrical cable (not shown) can be attached together using a cable gland 12 in conventional fashion. When the connector 2 is attached to an electrical cable (not visible), the cable gland 12 sealingly engages with the cable about the circumferential periphery of the cable, and also sealingly engages with the main body 8 of the first connector 2. The rear end of the cavity 10 (i.e. the end of the cavity which is furthest from the second connector 4 along the attachment axis 6) is therefore sealed closed.

In a similar fashion to the first connector 2, the second connector also has a main body 14 which defines a cavity 16 for receipt of an end of an electrical cable (not shown). Again, the electrical cable (not shown) and the second connector 4 can be attached to one another in known fashion using a cable gland 18, sealing closed the rear end of the cavity 16 (i.e. the end of the cavity which is furthest from the first connector 2 along the attachment axis 6).

It will be apparent from FIG. 1 that in this particular embodiment, the main bodies 8, 14 of the first and second connectors 2, 4 are substantially identical. This can reduce the manufacturing costs by reducing the number of different parts which are required to produce a pair of connectors, and by providing greater economies of scale. For the same reason, in this embodiment the cable glands 12, 18 are also substantially identical. In other embodiments, however, where appropriate the main bodies of the first and second connectors, and/or the cable glands for attachment to the first and second connectors, may differ from one another.

The first connector 2 has a plurality of electrical contacts 20, each of which projects into the cavity 10 for connection to an individual wire (not visible) of an electrical cable to which the first connector 2 is attached. Similarly, the second connector 4 has a set of electrical contacts 22 which project into the cavity 16 for attachment to wires of an electrical cable (not visible).

In this case the contacts 20 of the first connector 2 are female contacts and the contacts 22 of the second connector 4 are male contacts. However, it will be readily apparent to the skilled person that any other suitable arrangement may be used. For instance, the first connector 2 may have male contacts and the second connector 4, female contacts, each of the connectors 2, 4 may have a mixture of male and female contacts. Furthermore, although in this embodiments the contacts 20, 22 are of a conventional design, other embodiments may use contacts of any other suitable type and/or configuration (for instance contacts which each have a male portion and a female portion, or contacts which are neither male nor female and which merely abut with one another).

In this particular embodiment, the contacts 20 of the first connector 2 are held in respective bores in an electrically insulating insert 24 and an electrically insulating cover plate 26. Similarly, the contacts 22 of the second connector 4 are held in respective bores in an insulating insert 28 and cover plate 30. In this particular embodiment, the inserts 24, 28 and the cover plates 26, 30 are also substantially identical to one another. The inserts 24, 28 and cover plates 26, 30 space apart their respective sets of contacts 20, 22, preventing a short circuit (or excessive creepage), and also hold the contacts securely within their respective connectors 2, 4. As shown in FIG. 1, the female contacts 20 are recessed within the insert 24, and the male contacts 22 project from the insert 28. With the connectors 2, 4 attached together in the manner shown in FIG. 1, the male contacts 22 are received within corresponding female contacts 20, providing an electrical connection therebetween and allowing an electrical data signal or electrical current to pass between cables (not shown) attached to the connectors.

In some embodiments the front of the cavity 10 (i.e. the end of the cavity nearest to the second connector 4 along the attachment axis) and/or the front of the cavity 16 may be sealed closed, for instance by the associated insert 24, 28 or cover plate 26, 30. However, in this embodiment there are close tolerances between the components in front of each cavity 10, 16 but no seal is formed.

The first and second connectors 2, 4 are provided with respective handles 32, 34 by which they can be moved together or apart, and respective attachment portions 36, 38 for attaching the connectors to one another. In this particular embodiment the attachment portion 36 of the first connector 2 is attached directly to the main body 8 (in this case by screws 40), whereas the attachment portion 38 of the second connector 4 is attached indirectly to the main body 14. More specifically, the attachment portion 38 of the second connector 4 is attached to a support portion 42, and the support portion is attached to the main body 14 (also using screws 40 in this case). The structure and function of the attachment portions 36, 38 will be described in more detail below.

Figure 2:
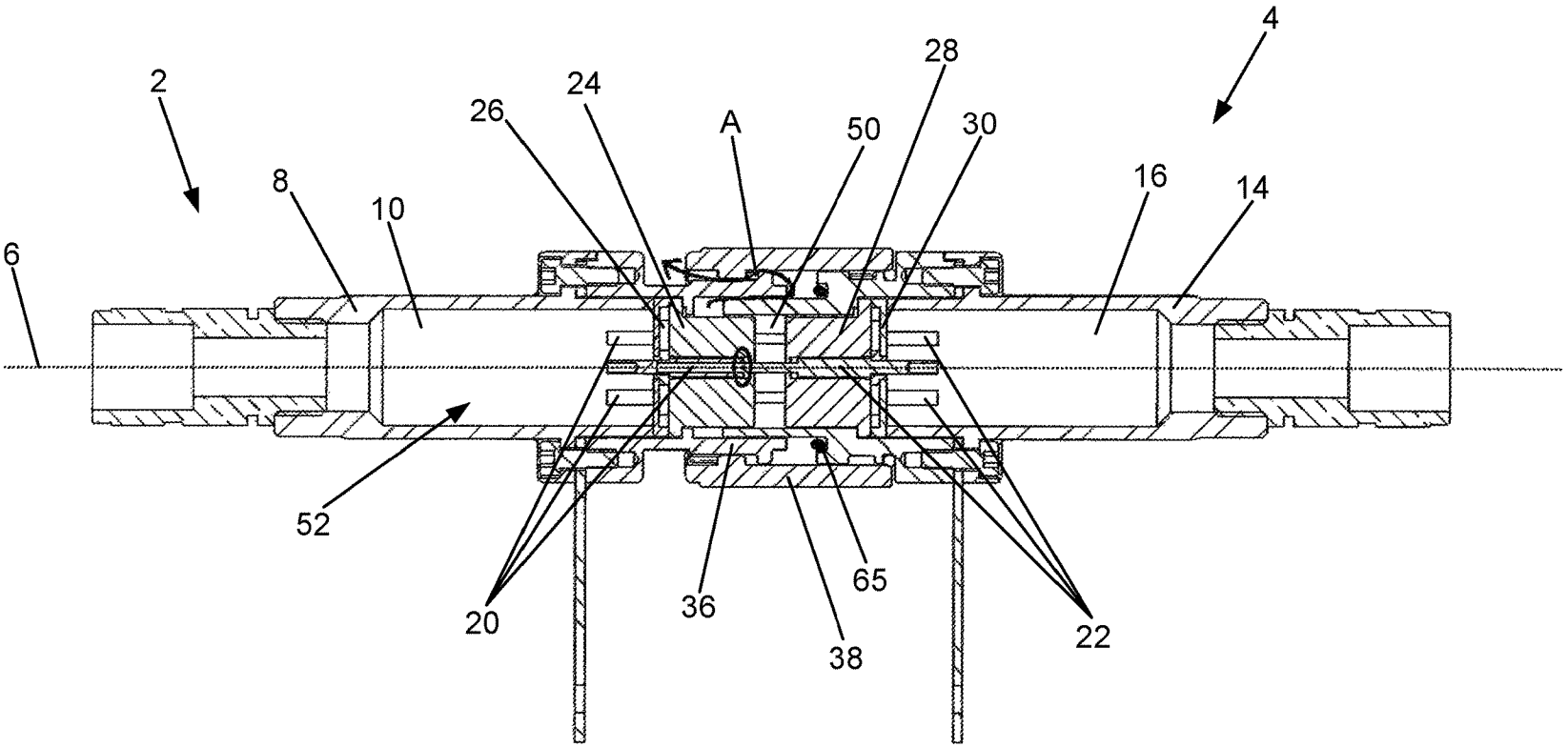
FIG. 2 is a cross-sectional side view of a pair of connectors according to the first embodiment of the invention, with the connectors in a configuration in which their respective contacts are close to one another.

FIG. 2 shows the first and second connectors 2, 4 moved apart from one another (relative to the position shown in FIG. 1) along the attachment axis 6. With the connectors 2, 4 in the position shown in FIG. 2, their respective contacts 20, 22 are almost but are not quite touching (in this case at their respective front ends, circled in FIG. 2). When the connectors 2, 4 are in the position shown in FIG. 2 (for instance while the connectors are being connected or disconnected) a spark may jump between their respective contacts 20, 22.

With the connectors 2, 4 attached to one another, the cavities 10, 16 of their respective main bodies 8, 14 are in communication with one another via a void 50 between the inserts 24, 28, and via leakage paths (not labelled) around the inserts 24, 28 and cover plates 26, 30 (since the front ends of the cavities 10, 16 are not sealed, as discussed above). The cavities 10, 16 (and in this embodiment the void 50 and the leakage paths around the inserts 24, 28 and cover plates 26, 30) cooperatively define a chamber 52. If the pair of connectors is used in an environment which may contain a flammable or explosive material, some of this material may also be present in the chamber 52. In such a case, a spark jumping between the contacts 20, 22 may ignite this material and cause a fire or explosion within the chamber 52. Such an explosion or fire causes hot gases to be produced within the chamber 52 which may force their way out of the chamber through what is known in the art as a "flame path".

In this embodiment the rear ends of the cavities 10, 16 (and thus the distal ends of the chamber 52) are sealed closed with sufficient strength for no such flame path to exist at those points. Instead, with the pair of connectors in the orientation shown in FIG. 2, the flame path leads from the chamber 52, to an external surface of one of the connectors 2, 4 (i.e. to the environment surrounding the connectors), between the attachment portions 36, 38 of the connectors. In this particular embodiment, potential flame paths exist between the attachment portions 36, 38 with the connectors 2, 4 in a continuous band around the attachment axis 6. However, in other embodiments one or more discreet flame paths may be provided instead, at any suitable location. Arrow A denotes an exemplary flame path within the continuous band of the present embodiment.

To prevent a fire or explosion within the chamber 52 from propagating to the environment surrounding the connectors, the flame path A is configured to be of sufficient length that any hot gases travelling along the flame path have cooled sufficiently by the time they exit, so that they are not hot enough to ignite any explosive or flammable material surrounding the connectors. In addition, with the connectors in the configuration shown, the first and second connectors 2, 4 are attached to one another so that any force produced by the explosion which tends to urge them axially away from one another (thereby shortening the length of the flame path) can be withstood. Accordingly, any spark occurring between the contacts 20, 22 is contained in a flameproof compartment and any resulting fire or explosion (as well as the spark itself) is allowed to dissipate without posing a risk to the surrounding environment. This is described in more detail below.

As indicated above, in conventional connectors for use in environments where explosive or flammable materials may be present, the two connectors are attached and detached by screwing and unscrewing threaded members connected thereto. For instance, the connectors may be attached to one another using bolts, or one connector may have an externally threaded shaft and the other connector an internally threaded sleeve. The connectors are arranged so that at the point during screwing/unscrewing at which the connectors' contacts are almost but are not quite touching, the flame path (which runs between the threaded members in the case of the latter example) is of sufficient length, and the threaded engagement is strong enough to prevent the connectors from being forced apart by an explosion or fire within a chamber of the connectors. However, manipulating threaded members (especially using a machine or while wearing gloves) can be awkward and time consuming, and the threads of the threaded members can be relatively prone to damage (either for instance from knocks or after cross-threading). The present invention provides an improved or alternative mechanism for attaching and detaching pairs of connectors, as outlined below.

Whilst in conventional connectors that use threaded members the operator performs a single manipulation (i.e. screwing/unscrewing) for a long period of time so as to attach or detach the connectors, in the present invention the first and second connectors 2, 4 are attached or detached by performing two different manipulations. More specifically, the first and second connectors 2, 4 are movable between a first configuration and a third configuration via a second configuration. A first manipulation is performed to move the connectors 2, 4 from the first configuration to the second configuration, and a second manipulation, which is different to the first manipulation, is performed to move the connectors from the second configuration to the third configuration. The connectors 2, 4 are attached to one another in the first and second configurations, and can only be detached from one another from the third configuration. This will be described in more detail below.

Figure 3:
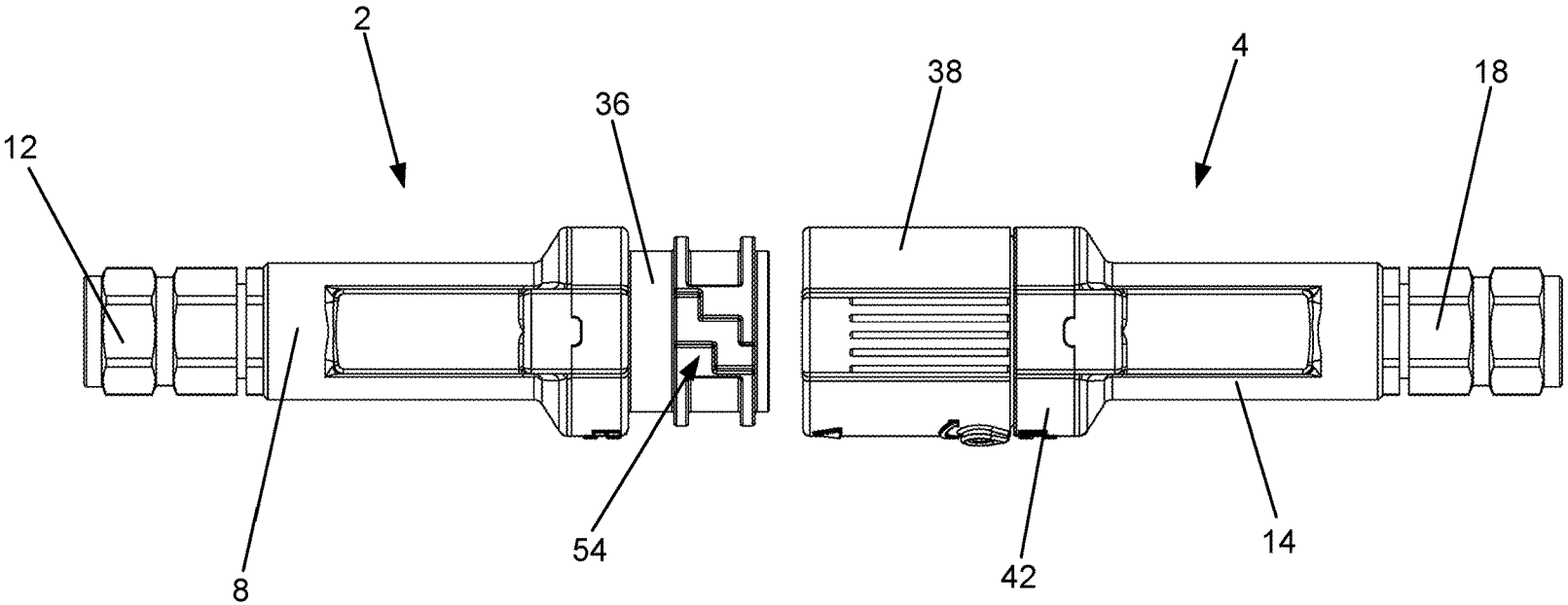
FIG. 3 is a plan view of a pair of connectors according to a first embodiment of the invention, separated from each other.
Figure 4:
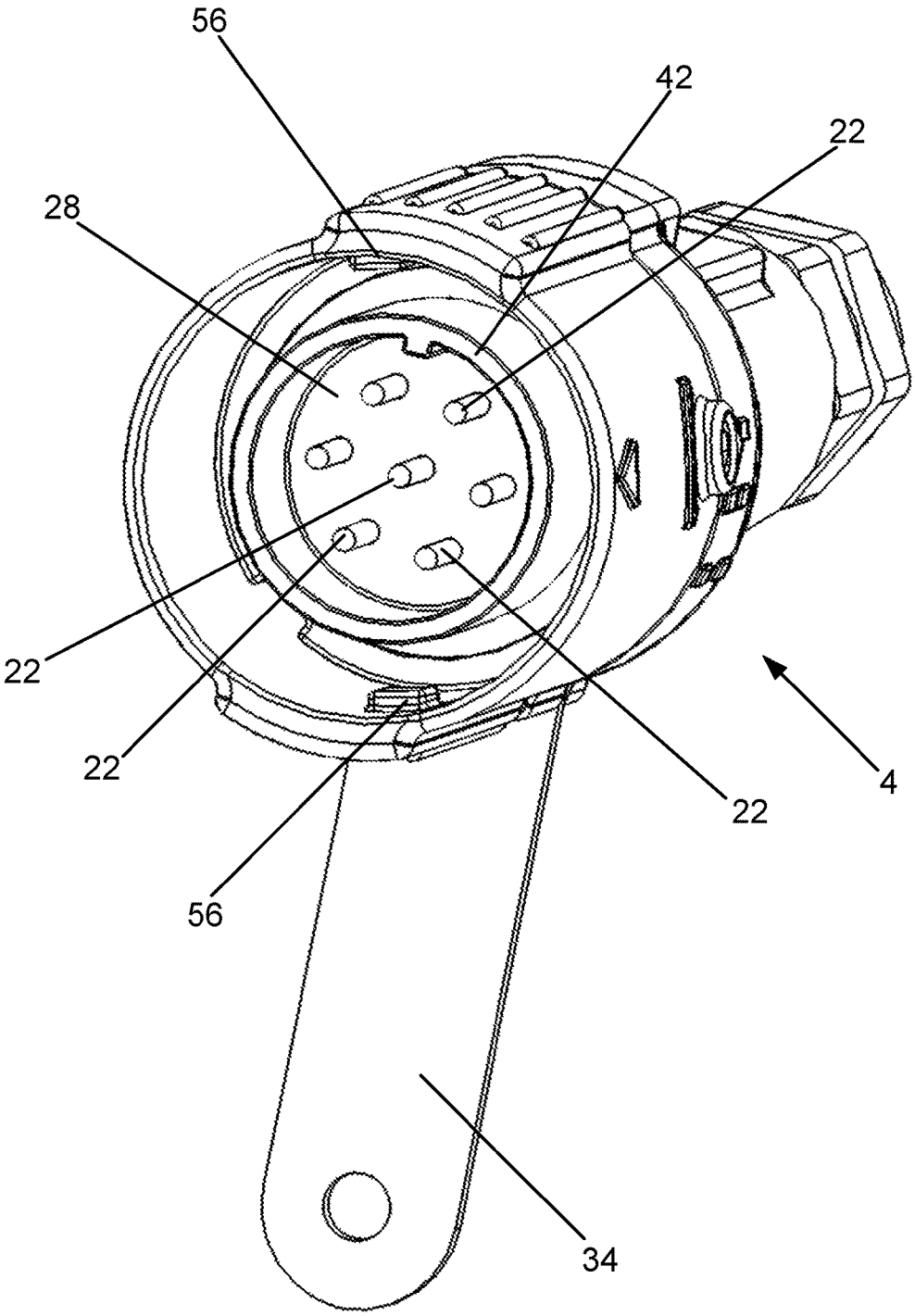
FIG. 4 is a perspective view of one of the connectors of the first embodiment of the invention.

Referring now to FIGS. 3 and 4, in this embodiment the attachment portion 20 of the first connector 36 defines two guideways 54 (only one of which is visible), and the attachment portion 38 of the second connector defines two lugs 56 which are receivable in respective guideways 54. In this case the lugs 54 project radially inwards relative to the attachment axis (not shown in FIGS. 3 and 4). FIG. 4 also illustrates the configuration of the contacts 22 in this particular embodiment. In this case there are seven contacts 22—a central contact surrounded by a substantially evenly-spaced substantially circumferential array of six other contacts. The contacts of the first connector 2 are not visible in FIGS. 3 and 4, but are arranged in the same configuration.

It is to be understood that the number of contacts and/or their spatial configurations may differ from what is shown in this embodiment. For instance, the optimum number and orientation of the contacts may be determined based on the space available within the connector, the number of separate connections which must be made, and the minimum clearance required between contacts so as to keep creepage at acceptable levels. Similarly, the size of the contacts may differ from what is shown in the first embodiment. Contact size may, for instance, be determined based on the maximum current which must be carried by that contact. Although in the first embodiment all the contacts are the same size, in other embodiments different size contacts may be present within a single connector. For instance, a connector may have one or more larger size contacts for carrying the current required for driving an electrical machine, and one or more smaller size contacts for carrying a data signal.

In this embodiment, the attachment portion 38 of the second connector 4 takes the form of a sleeve which is movable relative to the main body 14. More particularly, in this case the sleeve 38 is rotatable about the attachment axis relative to the main body 14. Referring briefly to FIG. 1, the sleeve 38 is rotatably mounted to the main body 14 by a projection 58 which is slidably received within a circumferential recess 60 in the support portion 42 (the support portion being attached to the main body by bolts 40, as discussed above). However, the skilled person will appreciate that in other embodiments a rotatable sleeve may be attached to the main body 14 in any other suitable fashion.

An o-ring 64 is positioned between the sleeve 38 and the support portion 42. The o-ring 64 seals the boundary between the sleeve 38 and support portion 42 in this region, closing any potential flame path in this region (which would be shorter than the flame path shown by arrow A in FIG. 2). The presence of the o-ring 64 also increases the amount of friction which opposes rotation of the sleeve 38 relative to the support portion 42 (and therefore relative to the main body 14), reducing the possibility of unintentional movement of the sleeve. The connectors 2, 4 of this particular embodiment have a further o-ring 65 positioned so as to be held axially compressed between the attachment portions 36, 38 when the connectors are in the first configuration. This o-ring 65 provides a seal against dirt and moisture ingress, rather than to close off a potential flame path.

Figure 5A:
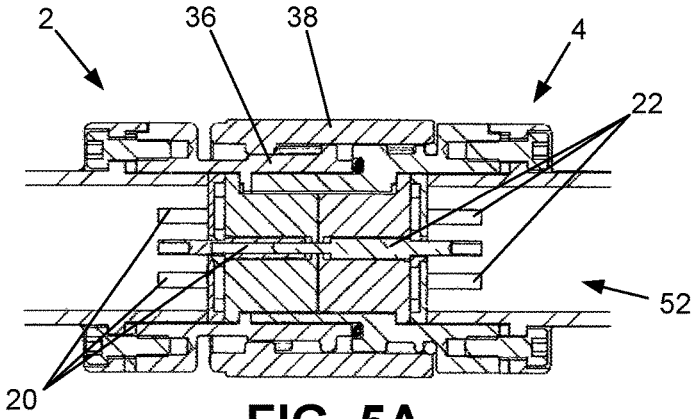
FIG. 5A is a cross-sectional side view of the front portions of the connectors of the first embodiment of the invention in the configuration shown in FIG. 1.
Figure 5B:
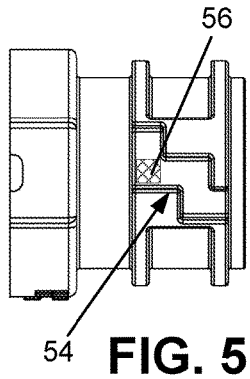
FIG. 5B is a top view of a guideway of one of the connectors, showing the position of a lug of the other connector when the connectors are in the configuration shown in FIG. 1.
Figure 6A:
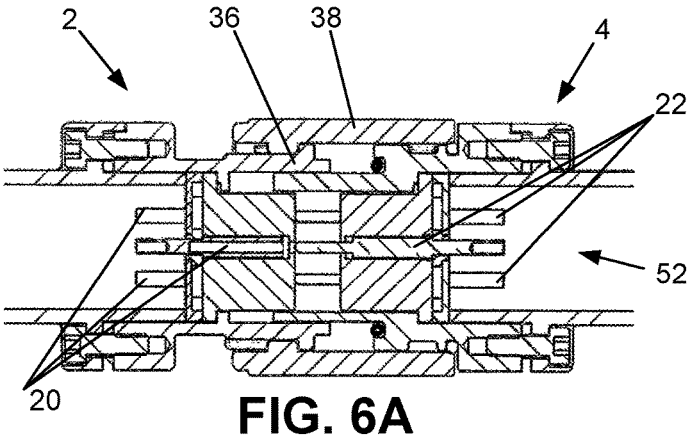
FIG. 6A is a cross-sectional side view of the front portions of the connectors of the first embodiment of the invention in a configuration in which their respective contacts are spaced apart from one another.
Figure 6B:
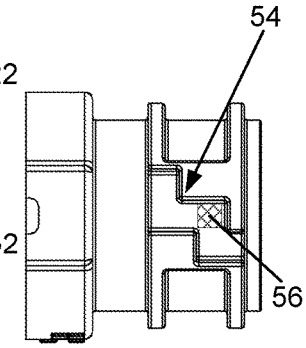
FIG. 6B is a top view of a guideway of one of the connectors, showing the position of a lug of the other connector when the connectors are in the configuration shown in FIG. 6A.
Figure 7A:
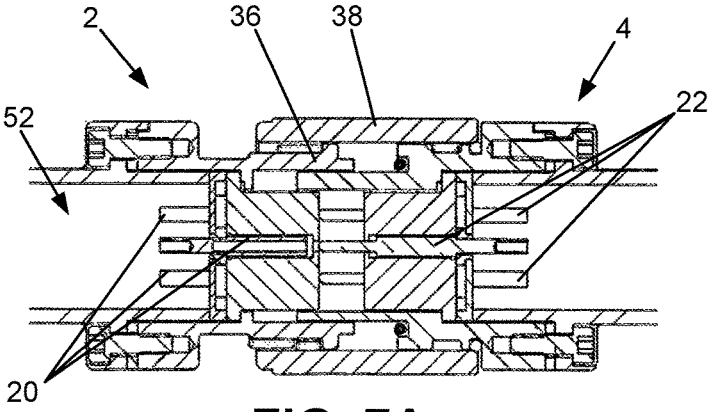
FIG. 7A is a cross-sectional side view of the front portions of the connectors of the first embodiment of the invention in a configuration from which the connectors can be detached from one another.
Figure 7B:
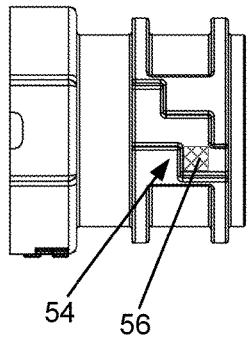
FIG. 7B is a top view of a guideway of one of the connectors, showing the position of a lug of the other connector when the connectors are in the configuration shown in FIG. 7A.

In this embodiment, movement of the first and second connectors 2, 4 between the first, second and third configurations is achieved by manipulating their respective attachment portions 36, 38 so as to move the lugs 56 within the guide-ways 54. FIGS. 5A, 6A and 7A show the positions of the connectors 2, 4 in the first, second and third configurations respectively. FIGS. 5B, 6B and 7B show the position of the upper lug 56 (from the perspective of FIGS. 5A, 6A and 7A) in the upper guide-way 54 (from the perspective of FIGS. 5A, 6A and 7A) for each configuration.

As shown in FIG. 5A, in the first configuration the contacts 20, 22 of the connectors 2, 4 are touching, and in the second configuration the contacts are not touching. Accordingly, any sparking between the contacts will take place during movement between the first configuration and the second configuration. In both the first and second configurations the connectors 2, 4 are attached to one another, and in this embodiment this attachment is strong enough to resist a force from a fire or explosion in the chamber 52 urging the connectors apart. That is, means are provided to retain the connectors 2, 4 from axial separation from the second configuration. This is discussed in more detail below. The connectors 2, 4 are arranged such that when in the second configuration, the flame path (A in FIG. 2) is of sufficient length in comparison to the volume of the chamber 52 that gas forced through the flame path A by a fire or explosion has cooled below the temperature at which it would ignite any flammable or explosive material in the surrounding environment by the time it emerges from the flame path. More particularly, the length of the flame path relative to the volume of the chamber 52 adheres to British Standard BS EN 60079-1:2007, which is incorporated herein by reference.

Furthermore, in this embodiment the connectors 2, 4 are configured such that a fire or explosion in the chamber 52 may move the connectors away from the first configuration and towards the second configuration, but cannot move them any further than the second configuration (i.e. towards the third configuration). Accordingly, if a spark jumps between the contacts 20, 22 while the connectors 2, 4 are being moved between the first configuration and the second configuration, the connectors are prevented from moving to a position in which the flame path is too short. The spark igniting flammable or explosive material within the environment is therefore avoided.

Connectors according to the invention can therefore provide the same level of safety as conventional connectors which use threaded members, but with two different manipulations being required to attach/detach them (instead of a single continuous manipulation as is the case with conventional connectors) may allow connectors according to the present invention to provide advantageous speed, simplicity and ease of use. In the case of the present embodiment, the above functionality is provided by the attachment portions 36, 38 of the first and second connectors 2, 4, and more specifically the first and second manipulations include relative movement of the attachment portions in different directions. This is discussed in more detail below.

Figure 8:
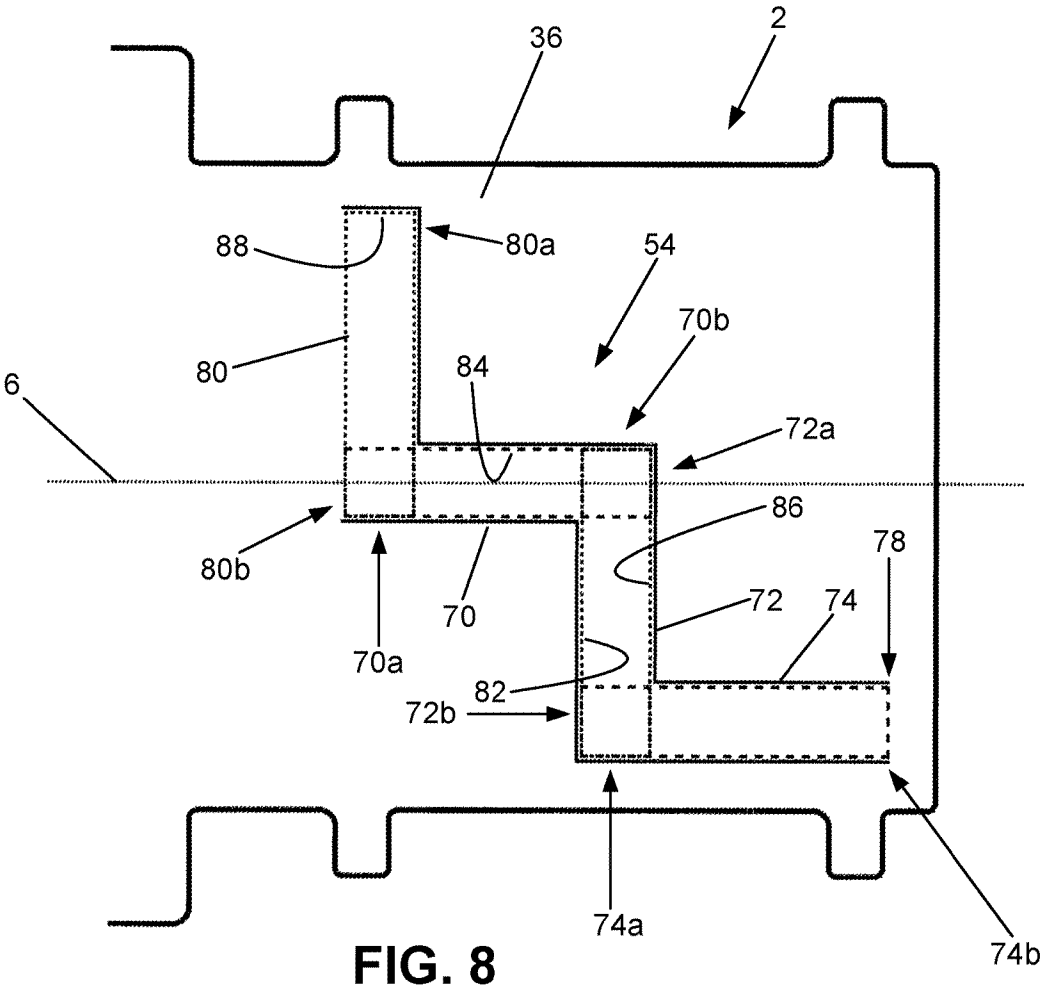
FIG. 8 is an exaggerated schematic plan view of the guideway of one of the connectors of the first embodiment of the invention.

FIG. 8 illustrates one of the guideways 54 of the attachment portion 36 of the first connector 2, with the shape of the guideway 54 exaggerated for the sake of clarity. The structure and function of the guideways 54 will be described in relation to this single guideway and its associated lug 56. It is to be understood that in this embodiment, the other guideway and the other lug have the same structure and interact in the same fashion.

The guideway 54 has a disconnection section 70, an intermediate section 72 and a release section 74. Each of the sections 70, 72 and 74 has two ends. One end 72*a* of the intermediate section 72 intersects an end 70*b* of the disconnection section 70, and the other end 72*b* of the intermediate section 72 intersects an end 74*a* of the release section 74. The end 74*b* of the release section 74 which does not intersect the intermediate section 72 has a mouth 78 through which the lug 56 can pass so as to allow the connectors to be separated from one another entirely. It will be apparent from FIG. 8 that if the lug 56 is positioned within the guideway 54 in the disconnection section 70 or in a part of the intermediate section 72 other than the end 72*b* that intersects the release section 74, the lug needs to be positioned at the intersection between the intermediate section 72 and release section 74 (at ends 72*b* and 74*a*) before it can pass out of the guideway 54 through the mouth 78. Accordingly, with the connectors 2, 4 in either the first configuration or the second configuration, movement to the third configuration is required before they can be detached entirely from one another.

As will be apparent by comparing FIGS. 5B, 6B and 7B to FIG. 8, with the connectors 2, 4 in the first configuration the lug 56 is received in the guideway 54 at the end 70*a* of the disconnection section 70 which does not intersect the intermediate section 72. Similarly, with the first and second connectors 2, 4 in the second configuration, the lug 56 is received in the guideway 54 at the end 72*a* of the intermediate section 72 which intersects the disconnection section 70. Furthermore, it will be apparent that with the connectors 2, 4 in the third configuration the lug 56 is received in the guideway 54 at the end 72*b* of the intermediate section 72 which intersects the release section 74. Accordingly, moving the connectors from the first configuration to the second configuration (i.e. performing the first manipulation) moves the lug 56 along the disconnection section 70 from the end 70*a* which does not intersect the intermediate section 72, to the end 70*b* which does intersect the intermediate section 72. Similarly, moving the connectors from the second configuration to a third configuration (i.e. performing the second manipulation) requires movement of the lug 56 from the end 72*a* of the intermediate section 72 which intersects the disconnection section 70 to the end 72*b* which intersects the release section 74.

In this embodiment, the disconnection section 70 is aligned substantially parallel to the attachment axis 6, the intermediate section 72 is aligned substantially circumferentially about the attachment axis, and the release section 74 is aligned substantially parallel to the attachment axis. Accordingly, to move the connectors 2, 4 from the first configuration to the second configuration (i.e. performing the first manipulation, requiring the lug to move from end 70*a* of disconnection section 70 to end 70*b* of disconnection section 70), the lug and guideway are move relative to one another along the attachment axis. In this embodiment, this is achieved by pulling the connectors 2, 4 apart along the attachment axis 6 (as described in more detail below), thereby pulling apart their respective attachment portions 36, 38. Similarly, to separate the connectors from the third configuration (which requires the lug 56 to move from end 74*a* of the release section to end 74*b* of the release section and out of the mouth 78), the lug and guideway are moved relative to one another along the attachment axis. Again, this is achieved by pulling the connectors 2, 4 apart along the attachment axis 6 so as to pull apart their respective attachment portions 36, 38. Furthermore, to move the connectors 2, 4 from the second configuration to the third configuration (i.e. performing the second manipulation, which requires the lug 56 to move from end 72*a* of the intermediate section 72 to end 72*a*), the attachment portions 36, 38 are rotated relative to one another about the attachment axis 6. In this embodiment, this is achieved by rotating the sleeve 38 about the attachment axis 6 relative to the main body 14 (thereby rotating it relative to the attachment portion 36 of the first connector 2).

Figure 9B:
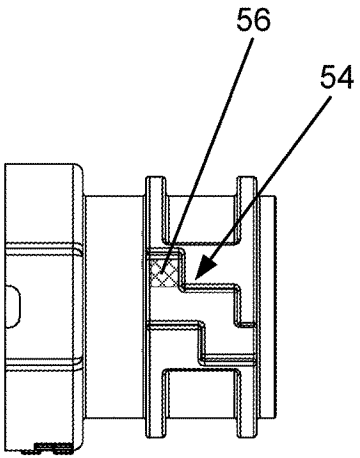
FIG. 9B is a top view of a guideway of one of the connectors, showing the position of a lug of the other connector when the connectors are in the configuration shown in FIG. 9A.
Figure 9A:
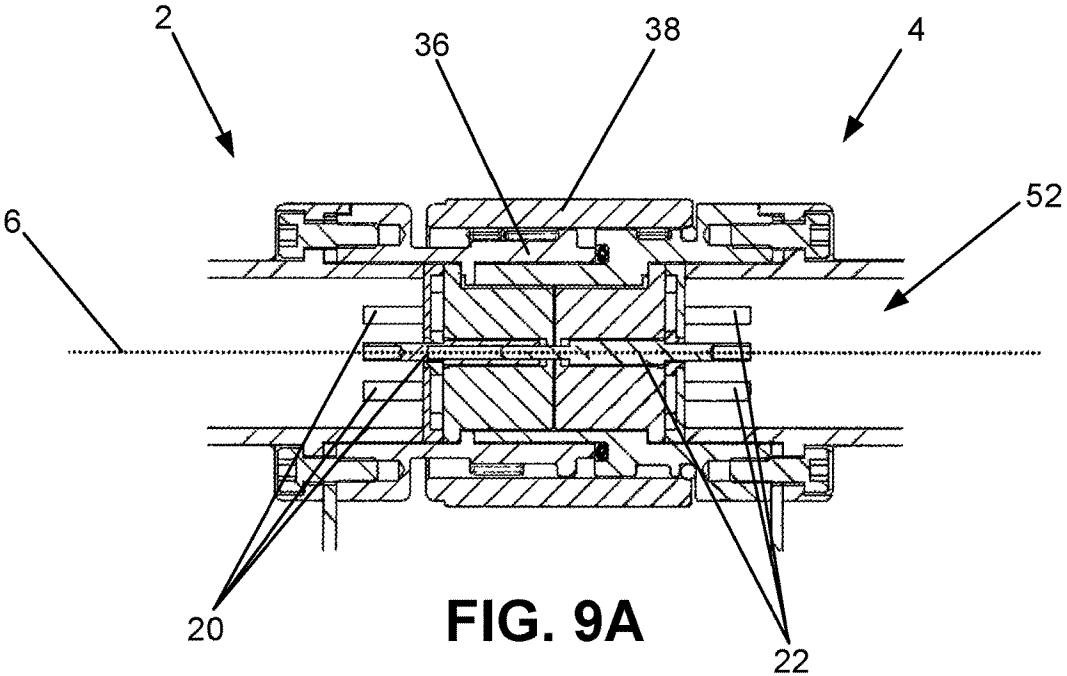
FIG. 9A is a cross-sectional side view of the front portions of the connectors of the first embodiment of the invention in a configuration in which they are secured with their respective contacts touching.

In this embodiment, the first and second connectors 2, 4 are also movable relative to one another between the first configuration and a fourth configuration. FIG. 9A shows the connectors 2, 4 in the fourth configuration, and FIG. 9B shows the position of the upper lug 54 (from the perspective of FIG. 9A) within the upper guideway 54 (from the perspective of FIG. 9A) when the connectors are in this configuration. The connectors 2, 4 being movable to the fourth configuration can reduce the risk of the connectors moving towards the second configuration (at which point their respective contacts 20, 22 cease to be in contact and any electrical/optical signal or electric current passing therebetween is interrupted) unintentionally. Movement of the connectors 2, 4 between the first and fourth configurations requires a third manipulation to be performed, as discussed below.

In this embodiment, the movement of the connectors 2, 4 between the first and fourth configurations is accommodated movement of the lug 56 within the guideway 54 due to the presence of an additional section of the guideway 42. Returning to FIG. 8, the guideway 54 also has a locking section 80. Like the disconnection section 70, intermediate section 72 and release section 74, the locking section 80 has two ends 80*a*, 80*b*. End 80*b* of the locking section intersects the disconnection section 70 at the end 70A thereof which does not intersect the intermediate section 72. In this embodiment the locking section 80 is not fully enclosed—its rear side (its left side from the perspective of FIG. 8) is left open. However, the connectors 2, 4 are configured such that the electrically insulating inserts which support the contacts (not shown in FIG. 8) abut, thereby preventing the connectors from moving any further towards one another. This prevents the lug (not visible in FIG. 8) from moving axially rearwards out of the locking section 80. It should be noted, however, that in other embodiments the locking section may be fully enclosed and/or other sections of the guideway may not be fully enclosed.

To perform the third manipulation in this embodiment, the lug 56 is moved from the intersection between the disconnection section 70 and the locking section 80 to the end 80*a* of the locking section which does not intersect the disconnection section. In this particular embodiment the locking section 80 is aligned substantially circumferentially around the attachment axis 6, therefore to perform the third manipulation the attachment portions 36, 38 are rotated relative to one another about the attachment axis 6. In the present embodiment this is achieved by rotating the sleeve 38 about the attachment axis 6 relative to the main body 14 (thereby rotating it relative to the attachment portion 36 of the first connector 2). Accordingly, in this case the third manipulation is the same as the second manipulation.

The process for connecting and disconnecting the connectors 2, 4 will now be described with reference to FIGS. 1 and 5A to 9B. For simplicity, this process will be described in relation to the movement of one lug 56 through the corresponding guideway 54. It is to be understood that the other lug interacts with the other guideway in the same fashion.

To connect the connectors 2, 4, they are introduced towards one another along the attachment axis 6, with the attachment portions 36, 38 of the connectors positioned at the appropriate angle relative to one another for the lug 56 to enter the guideway 54 through the mouth 78 of the release section 74 of the guideway. The connectors 2, 4 continue to be moved towards one another along the attachment axis 6, during which time the lug 56 travels along the release section 74 of the guideway 54 towards end 74*a*. When the lug 56 reaches the end 74*a* of the release section which intersects the end 72*b* of the intermediate section 72, the connectors 2, 4 are in the third configuration. At this point, further axial movement of the connectors 2, 4 towards one another is prevented by the lug 56 contacting a wall 82 of the guideway 54.

With the connectors 2, 4 in the third configuration, the second manipulation of this embodiment is performed—the sleeve 38 is rotated about the attachment axis 6 relative to the main body 14 of the second connector (and therefore relative to the main body 8 and the attachment portion 36 of the first connector 2). That is, an external force is applied to the sleeve 38 so as to move it in a direction which is transverse to the attachment axis 6. The lug 56 therefore begins to travel along the intermediate section 72 of the guideway 54, from the end 72*b* which intersects the release section 74, towards the end 72*a* which intersects the disconnection section 70. When the sleeve 38 reaches the angular position relative to the attachment portion 36 at which the lug 56 is received at the intersection between the intermediate section 72 and the disconnection section 70, the connectors are in the second configuration. Further circumferential movement of the sleeve 38 relative to the attachment portion 36 is then prevented by the lug 56 contacting another wall 84 of the guideway 54.

The connectors 2, 4 (and thus their attachment portions 36, 38) are then pushed towards one another along the attachment axis 6, thereby performing the first manipulation of this embodiment. This moves the lug 56 along the disconnection section 70 from the end 70*b* which intersects the intermediate section 72 to the end 70*a* which intersects the locking section 80 (i.e. the end which does not intersect the intermediate section 72). As the connectors 2, 4 move towards one another and the lug 56 travels along the disconnection section, the connectors reach a position at which their respective contacts 20, 22 are almost but are not quite touching (i.e. the position shown in FIG. 2). If a spark jumps between the contacts 20, 22 at that point and ignites flammable or explosive material within the chamber 52, the connectors 2, 4 may be forced apart from one another by gases released by a fire or explosion within the chamber. However, if the connectors 2, 4 are forced apart by a fire or explosion, they cannot move apart beyond the second configuration because at that point the lug 56 is prevented from moving any further in the axial direction by a wall 86 of the guideway. Wall 86 therefore functions as a stop surface to prevent axial separation of the connectors 2, 4.

Since the flame path (Arrow A in FIG. 2) with the connectors 2, 4 in the second configuration is of sufficient length that when any gas produced by a fire or explosion in the chamber 52 exits the flame path the gas has cooled below the temperature which would ignite explosive or flammable material around the connectors, any such fire or explosion is prevented from propagating. If no such fire or explosion occurs, the connectors 2, 4 can continue to move towards one another along the attachment axis 6 until they reach the first configuration, at which point their respective contacts 20, 22 are touching and the lug 56 is received at the intersection between the disconnection section 70 and the locking section 80 (i.e. at the end 70*a* of the disconnection section 70 which does not intersect the intermediate section 72). In some situations the connectors 2, 4 may also be moved to the first configuration after a fire or explosion has taken place within the chamber 52, however in some cases it may be preferable for the connectors 2, 4 to be inspected (for instance to check the integrity of the seals provided by the cable glands 12, 18 and the o-ring 64) before returning them to service.

In some embodiments the connectors 2, 4 may remain in the first configuration during normal use (for instance while electrical/optical signals or electric current passes between their respective contacts, 20, 22). For instance, there may be sufficient friction between the first and second connectors 2, 4 to prevent them being moved towards the second configuration inadvertently (for instance by a knock). However, in this embodiment the connectors 2, 4 are moved from the first configuration to the fourth configuration for the sake of additional protection from accidental disconnection of their contacts 20, 22. To move the connectors 2, 4 from the first configuration to the fourth configuration (i.e. to perform the third manipulation), the sleeve 38 is rotated around the attachment axis 6 relative to the main body 14 of the second connector 4 (and thus relative to the main body 8 and attachment portion 36 of the first connector 2). This causes the lug 56 to travel along the locking section 80 from the end 80*b* which intersects the disconnection section 70 to the end

80*a* which does not intersect the disconnection section. When the sleeve has rotated to the point at which the connectors 2, 4 are in the fourth configuration, further rotation of the sleeve 38 is prevented by a wall 88 of the guideway 54 contacting the lug 56.

To disconnect the connectors 2, 4, the above procedure is reversed. Firstly, the third manipulation is performed such that the sleeve 38 is rotated about the attachment axis 6 so that the lug 56 travels along the locking section 80 of the guideway 54 from the end 80*a* which does not intersect the disconnection section 70. When the lug 56 reaches the intersection between the locking section 80 and the disconnection section 70, the connectors are back in the first configuration. At that point, the first manipulation is performed to move the connectors 2, 4 from the first configuration to the second configuration—the connectors, 2, 4 are pulled apart from one another along the attachment axis 6, therefore the lug 56 travels along the disconnection section 70 towards the intermediate section 72. Again, as the connectors 2, 4 move apart from one another along the attachment axis 6, they reach a point at which their respective contacts, 20, 22 are almost but are not quite touching.

In the same manner as described above, if a spark jumps between the contacts 20, 22 and ignites an explosive or flammable material within the chamber 52, the gases produced may force the connectors apart to the second configuration but further movement apart is prevented by the wall 86 of the guideway 54 contacting the lug 56. If no such fire or explosion takes place, or if the fire or explosion does not provide sufficient force to move the connectors 2, 4 to the second configuration, they continue to be pulled apart until they reach the second configuration. The second manipulation is then performed—the sleeve 38 is rotated once again, moving the lug 56 along the intermediate section 72 from the end 72*a* which intersects the disconnection section 70 to the end 72*b* which intersects the release section. In other words, an external force is applied to the sleeve 38 to move it in a direction which is transverse to the attachment axis 6. When the sleeve 38 has been rotated sufficiently for the lug 56 to be received at the intersection between the intermediate section 72 and the release section 74, the connectors 2, 4 are in the third configuration. At that point, the connectors 2, 4 are pulled apart from one another along the attachment axis 6, the lug travels along the release section 74 and exits through the mouth 78 at the end 74*b* of the release section 74 which does not intersect the intermediate section 72. The connectors can then be separated from one another entirely.

Figure 10:
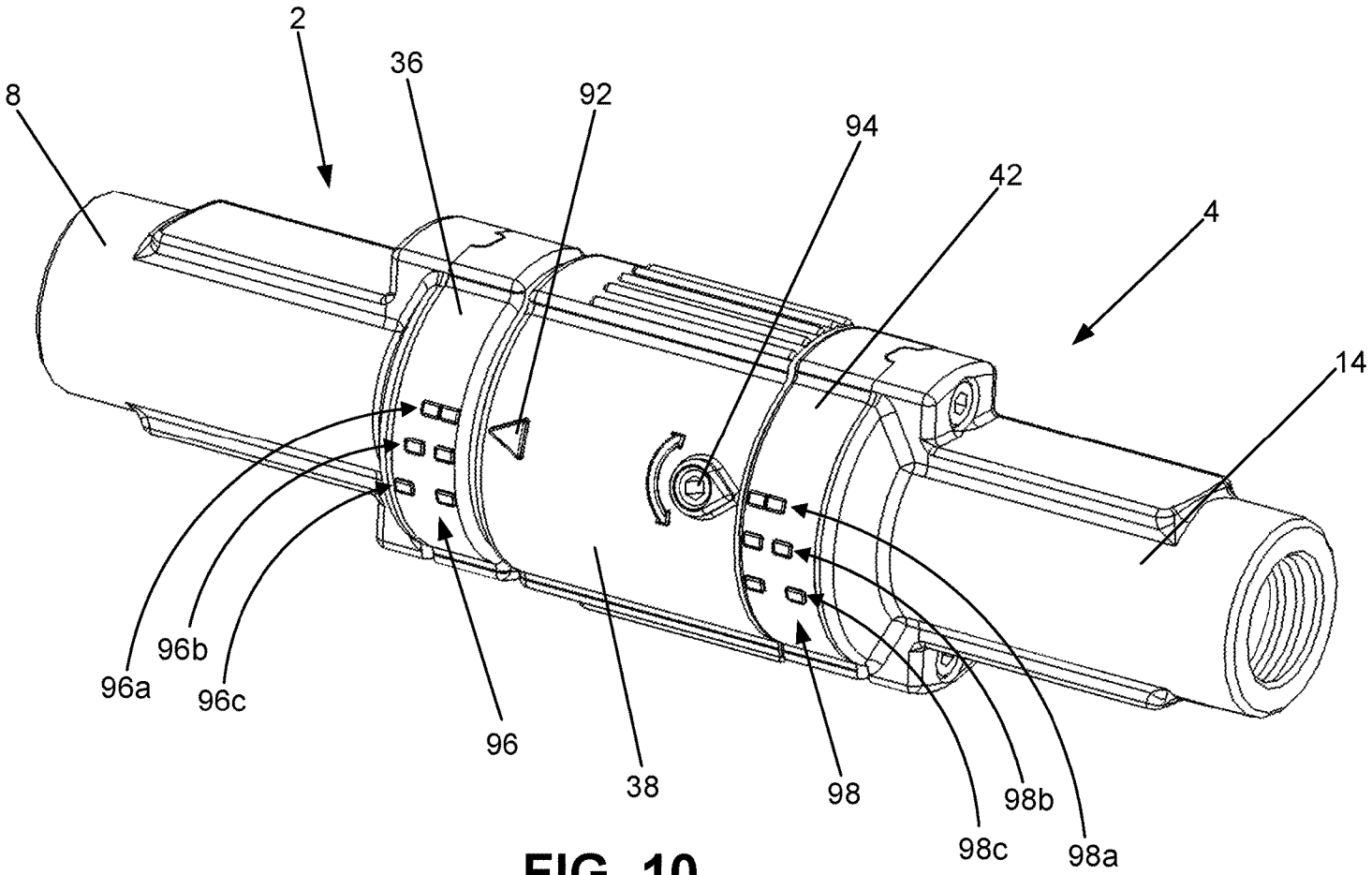
FIG. 10 is a perspective view of the connectors of the first embodiment of the invention.

FIG. 10 shows the sleeve 38 provided with two pointers 92, 94. Pointer 92 is used in conjunction with indicia 96 provided on the first connector 2 (in this case on its attachment portion 36), and pointer 94 is used in conjunction with indicia 98 provided on the second connector 4 (in this case on its support portion 42). Each set of indicia 96, 98 comprises three graduations 96*a*-96*c*, 98*a*-98*c*.

Pointer 94 and indicia 98 cooperatively form markings which indicate the position of the sleeve 38 relative to the support portion 42 (and thus relative to the main body 14 of the second connector 2) as follows. Pointer 94 being aligned with graduation 98*a* indicates that the sleeve 38 is in the rotational position relative to the main body 14 of the second connector 4 that corresponds to the connectors 2, 4 being in the fourth configuration described above. Pointer 94 being aligned with graduation 98*b* indicates that the sleeve 38 is in the rotational position relative to the main body 14 of the second connector 2 that corresponds to the connectors being in first configuration or the second configuration. The pointer 94 being aligned with graduation 98*c* indicates that the sleeve 38 is in the rotational position relative to the main body 14 that corresponds to the connectors 2, 4 being in the third configuration (or in a position at which they had been pulled axially apart from the third configuration, with the lug 56 positioned at some point along the length of the release section 74 of the guideway 54).

Although the markings formed by the pointer 94 and indicia 98 give an indication of the position of the sleeve 38 relative to the main body 14 of the second connector 4, the axial spacing between portions of the first and second connectors (e.g. the sleeve 38 of the second connector 4 and the attachment portion 36 of the first connector) should also be assessed in order for the configuration of the connectors 2, 4 to be deduced with any certainty. For instance, the sleeve 38 may be rotated relative to the main body 14 of the second connector 4 so that the pointer 94 is aligned with graduation 98*a* while the connectors 2, 4 are completely separate from one another. The markings formed by the pointer 94 and the graduation 98*a* may suggest that the connectors are in the fourth configuration, but an operator would note from the presence of a gap between sleeve the front end of the sleeve 38 and the front end of the visible part of the attachment portion 36 that this is not the case. Similarly, if the operator were to note that the pointer 94 was aligned with the graduation 98*b*, he would deduce whether the connectors 2, 4 were in the first configuration or the second configuration (or neither) based on the space between the front end of the sleeve 38 and the front end of the visible part of the attachment portion 36.

Pointer 92 and indicia 96 work in the same fashion as pointer 94 and indicia 98, but denote the angular position of the sleeve 38 relative to the attachment portion 36 of the first connector 2. The indicia 96, 98 of this embodiment can perform another function—showing whether or not the attachment portion 36 of the first connector 2 is rotationally aligned with the support portion 42 of the second connector 4. This indication then provides a guide as to whether or not the contacts 20, 22 of the connectors 2, 4 are aligned with one another so that (at the appropriate point) the male contacts 22 can enter the female contacts 20.

In this case the three graduations 96*a*-96*c*, 98*a*-98*c* each have a shape which represents the possible configuration(s) of the connectors (two blocks touching each other to represent the fourth configuration, two blocks nearby each other to represent the first or second configuration, and two blocks further apart to represent the third configurations). However, it will be appreciated that in other embodiments any other suitable arrangement of markings may be used. For instance, the sleeve may comprise the indicia rather than the pointer, and/or the or each set of indicia may comprise greater than or fewer than three graduations (for instance a single graduation, the position of the sleeve being determined by the relative positions of the graduation and the corresponding pointer). Instead or in addition, in some embodiments markings may be provided which indicate the axial spacing between components of the connectors (for instance the part of the attachment portion 36 which is received within the sleeve 38 may be provided with axially-arranged indicia).

Figure 11:
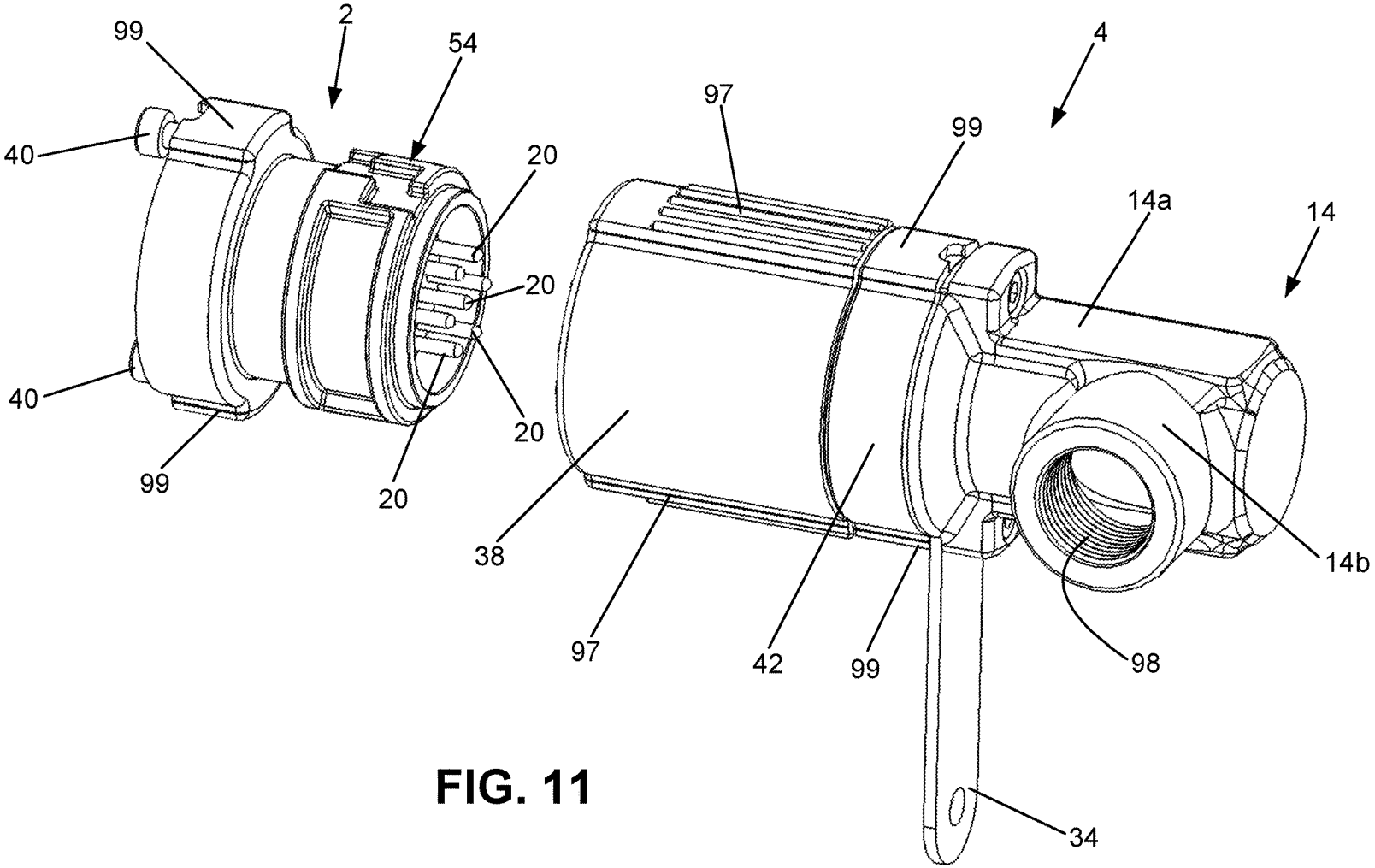
FIG. 11 is a perspective view of a pair of connectors according to a second embodiment of the invention.

A pair of connectors according to a second embodiment of the invention is shown in FIG. 11. The second embodiment is similar to the first, therefore only the differences will be described here. Firstly, in this embodiment the first connector 2 is not configured for attachment to an electrical cable. Instead, the first connector 2 is arranged to be secured to a casing of an electrical unit (not visible) such as a sensor assembly or sensor readout screen, in this case by bolts 40.

Since the first connector is intended to be attached to a casing of an electrical unit, the first connector 2 can be moved by moving the electrical unit. The first connector 2 therefore is not provided with a handle. Furthermore, although the contacts 20 of the first connector are arranged in the same spatial configuration as the first embodiment, in this embodiment the contacts 20 of the first connector 2 are male contacts and the contacts (not visible) of the second connector 4 are female.

The second embodiment also differs from the first embodiment in that the main body 14 of the second connector 4 defines a right angle turn—the first portion 14*a* of the main body 14 is aligned with the attachment axis (not shown), and a second portion 14*b* projects perpendicularly therefrom. The second portion 14B has a threaded bore 98 for receipt of a cable gland (not shown) so that the second connector can be attached to an electrical cable in a conventional manner.

It will also be apparent that the connectors 2, 4 of the second embodiment do not have markings to indicate the rotational position of the sleeve 38. In this case, an operator can rely on tactile feedback to determine what configuration the connectors 2, 4 are in, and/or may make a judgment based on the relative positions of raised and textured portions 97 of the sleeve 38 relative to raised portions 99 provided on the first and second connectors 2, 4.

Figure 12:
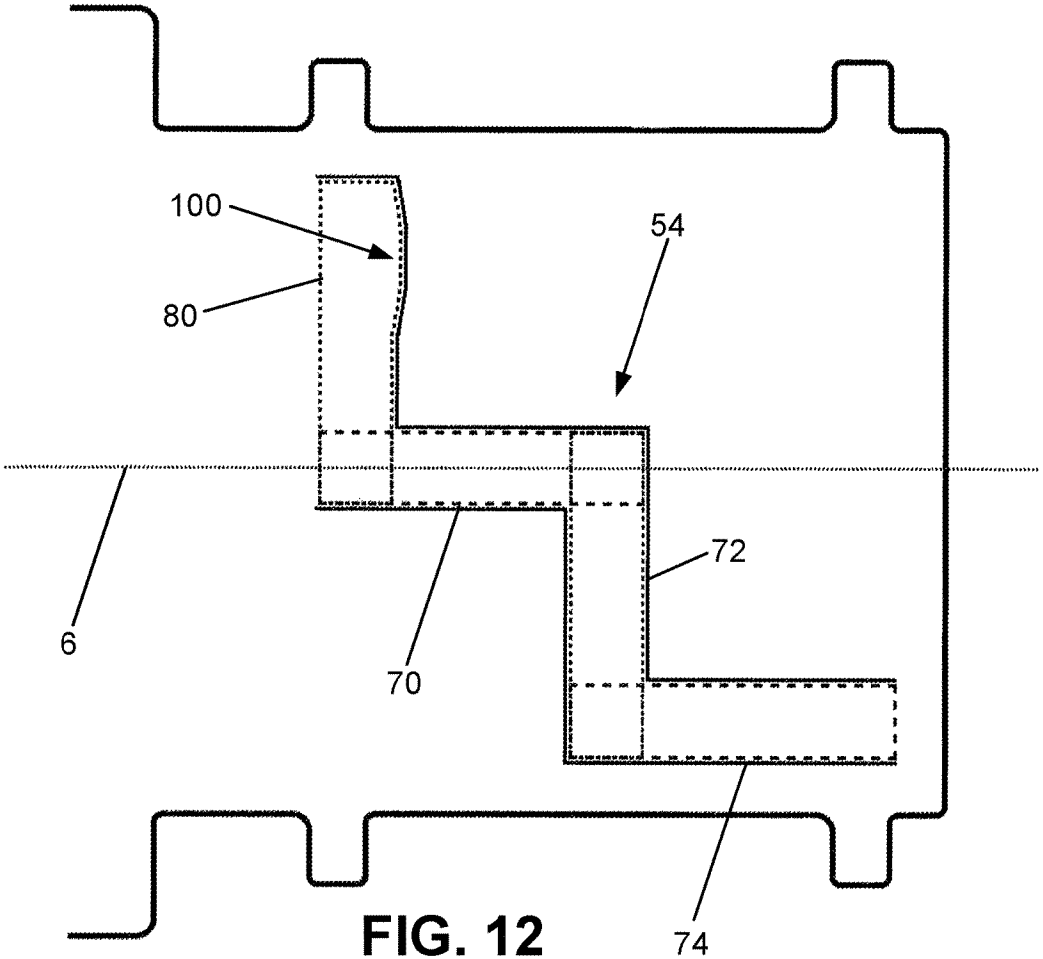
FIG. 12 is an exaggerated schematic plan view of the guideway of one of the connectors of the second embodiment of the invention.

The shape of the guideways 54 (only one of which is visible in FIG. 11) of the first connector 2 also differs from the first embodiment. FIG. 12 shows a schematic representation of the upper guideway 54 (from the perspective of FIG. 11), with the shape of the guideway exaggerated for the sake of clarity. The disconnection section 70, intermediate section 72 and release section 74 of the guideway 54 are substantially the same as the corresponding sections of the guideway of the first embodiment. However, in the second embodiment, the locking section 80 has a recess 100 into which the lug 56 can be received. Furthermore, in this embodiment the o-ring which is axially compressed between the attachment portions 36, 38 when the connectors 2, 4 are in the first configuration (reference 65 in FIG. 1) is also axially compressed when the connectors 2, 4 are in the fourth configuration. The restorative force from the axial compression of this o-ring urges the attachment portions 36, 38 (and thus the connectors 2, 4) axially apart.

With the connectors 2, 4 in the fourth configuration, the lug 56 is aligned with the recess 100 of the locking section 80. The attachment portions 36, 38 being urged apart by the o-ring (56 in FIG. 1) urges the lug 56 into the recess 100 in the guideway 54. The o-ring therefore acts as a resilient member which biases the lug 65 into the recess 100. The o-ring urging the lug 56 into the recess 100 may reduce the risk of the connectors inadvertently being moved from the fourth configuration to the first configuration (for instance by a knock), since moving the lug out of the recess 100 requires the o-ring to be axially compressed again, and therefore more force is required than if moving the lug within a locking section 80 merely required friction to be overcome. In other embodiments this functionality may be provided by a different component or set of components. For instance, the electrically insulating inserts may be slightly elastic, and be configured so that when the connectors are in the fourth configuration they are compressed slightly and urge the connectors apart along the attachment axis 6.

A schematic illustration of a third embodiment of the invention is shown in FIG. 13. In this embodiment each connector 2, 4 has a single contact 20, 22 in the form of a flat plate. The plates 20, 22 abut when the connectors 2, 4 are in the first configuration. In this embodiment, the first connector 2 is provided with an attachment portion in the form of a pair of flat guide-plates 102 (one of which is shown in FIG. 13). Each side plate 102 of the first connector has a guideway 54 that has a disconnection section 70, an intermediate section 72 and a release section 74. The attachment portion of the second connector 4 has a pair of lugs 56 in the form of short pins projecting from either side. The pins 56 are receivable in the guideways 54. As with previous embodiments, the attachment mechanism of the connectors 2, 4 will be described in relation to a single lug 56 and guideway 54, it being understood that the same process also occurs at the other guideway (not visible) with respect to the other lug (not visible).

It will be apparent from FIG. 13 that the disconnection section 70 and the release section 74 of the guideway 54 are aligned substantially parallel to the attachment axis 6. Accordingly, moving the connectors from the first configuration to the second configuration (i.e. performing the first manipulation, moving the lug 56 along the disconnection section 70 towards the intermediate section 72) requires relative movement of the connectors 2, 4 away from one another in a direction parallel to the attachment axis 6, as was the case with the first and second embodiments. The same applies in relation to moving the connectors (and thus their attachment portions) from the third configuration to a configuration in which they are entirely separate (i.e. moving the lug 56 along the release section 74 away from the intermediate section 72). However, it will be apparent that the intermediate section 72 is not positioned circumferentially around the attachment axis 6. Instead, the intermediate section 72 runs along a straight path which is positioned at an angle to the attachment axis 6 (from the perspective of FIG. 13). Accordingly, moving the connectors 2, 4 from the second configuration to the third configuration (i.e. performing the second manipulation, moving the lug 56 along the intermediate section 72 away from the disconnection section 70 and towards the release section 74) does not require relative rotation about the attachment axis 6. Instead, the connectors 2, 4 are moved relative to one another in a linear direction which has a vector component in a direction which is transverse to the attachment axis 6 (i.e. the vertical direction from the perspective of FIG. 13).

A schematic illustration of a fourth embodiment of the invention is shown in FIG. 14. In this case, the connectors 2, 4 do not have a guideway and lug respectively. Instead, they can be attached to one another using a pivotable catch 104 with a head 106 and button 108 (that forms the attachment portion of the second connector 4), which interacts with a ridge 110 which forms the attachment portion of the first connector 2. In the first configuration the connectors 2,4 are closer together than is shown in FIG. 14, with their respective contacts 20, 22 touching and the head 106 of the catch 104 positioned further behind the ridge 110 than is shown. In the second configuration the connectors 2, 4 are spaced apart from one another along the attachment axis 6 (relative to the position shown in FIG. 14), their respective contacts 20, 22 do not touch and the head 106 of the catch 104 abuts the rear of the ridge 110. In the third configuration the connectors 2, 4 are spaced apart further still, and the head 106 of the catch 104 is positioned in front of the ridge 110.

In this embodiment, to move the connectors 2, 4 from the first configuration to the second configuration (i.e. to perform the first manipulation) they are pulled apart along the attachment axis 6. To move the connectors 2, 4 from the second configuration to the third configuration are again be pulled apart along the attachment axis. In addition, however, the catch 104 is pivoted by applying an external force to the button 108 so as to lift its head 106 over the ridge 110. This is the second manipulation.

Although the above embodiments have been described in relation to the contacts of the connectors carrying sufficient electrical loading for sparking to occur, the present invention is not limited in applicability to such circumstances. For instance, as noted above, in some countries connectors for carrying low voltage electrical signals (for instance USB or Ethernet data connectors) must often be explosion-proof since they are rarely certified as being intrinsically safe, even if there is no significant risk of them sparking. In such circumstances, the present invention may also be utilised. For instance, in a modification of the first embodiment, the set of male contacts 22 is replaced by a male USB connector (i.e. a USB 'plug') positioned within a suitably shaped insert 28, and the set of female contacts 20 is replaced by a female USB connector (i.e. a USB 'socket') positioned within a suitably shaped insert 24.

The above modification uses conventional (albeit ruggedly designed) USB connectors. This may enable easy identification of the USB data connectors in the case that there are multiple sets of connectors in proximity to one another, and may also reduce production costs by allowing more off-the-shelf components to be used. In other cases, however, the invention may be applied to low voltage electrical connectors such as USB connectors while using the same contacts as are used for high voltage applications. For example, a USB cable may be wired to contacts of the same form as those of the first embodiment, each data line of the USB connection being wired to a different pin. Furthermore, connectors according to the present invention may utilise contacts of non-conventional structure to carry conventional data signals. For example, connectors according to the present invention may utilise proprietary Ethernet connectors in place of conventional contacts when carrying an Ethernet data signal.

As also noted above, optical connectors are increasingly being required to be explosion proof, due to legal limits on the amount of optical power which can be exposed in hazardous environments such as those in which flammable and/or explosive materials may be present. As one example, in a modification of the third embodiment of the invention the electrical contacts 20, 22 are replaced with optical contacts configured to transmit an optical signal when they contact one another (in this case through their opposing flat front faces), each contact being in communication with an optical cable such as a fibre-optic cable. In this case, the optical contacts are of conventional design, and have an auxiliary biasing mechanism which biases the fronts of the contacts towards one another (when the connectors are in the first configuration) so as to hold them against one another and thereby maintain the integrity of an optical signal passing between them.

In the above arrangement, if sufficient optical power exits the contacts when they part from one another during movement of the connectors from the first configuration to the second configuration, any fire or explosion ignited by that optical power would be contained by the connectors in the same manner as described above. In short, force from the fire or explosion may push the connectors to the second configuration but would not move them from the second configuration towards the third configuration, and when in the second configuration the connectors provide a flame path of sufficient length that hot gas from any fire or explosion ignited by the contacts would have cooled to a safe level by time it reached the environment.

The invention may also be applied to more than one type of connection at once. For instance, an electrical machine may be coupled to an external control device through a single pair of connectors, that pair of connectors having contacts for the transmission of drive current to the machine, and also contacts for carrying a data signal from one or more feedback sensors positioned on the machine.

For completeness, it should be noted that the invention may even be used where the maximum power output from the contacts (whether electrical or optical) is certified as being intrinsically safe. As discussed above, explosion-proof connectors (such as those provided by the present invention) may be utilised at the boundary of an 'Ex d' enclosure so as to maintain the integrity thereof, even if the connectors themselves do not present an ignition/detonation risk.

The described and illustrated embodiments are to be considered as illustrative and not restrictive in character, it being understood that only preferred embodiments have been shown and described and that all changes and modifications that come within the scope of the invention as defined in the claims are desired to be protected. For instance, in a modification of the first embodiment of the invention the contacts are not received in electrically insulating inserts and cover plates. The contacts may instead be provided with individual insulating coatings, and be received in an electrically conducting portion of their respective connectors.

It is to be understood that although sparking is described above as occurring when the connectors are at a particular intermediate point between the first and second configurations, it is to be understood that the exact position of the connectors at which a spark occurs may vary, depending on (for instance) the instantaneous voltage difference between the contacts of the connectors. Sparking may therefore potentially take place through a range of different connector positions and/or at different times (including the time at which the connectors reach the first configuration or the second configuration). The same applies in relation to ignition/detonation due to optical output from an optical contact.

In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

Optional and/or preferred features as set out herein may be used either individually or in combination with each other where appropriate and particularly in the combinations as set out in the accompanying claims. The optional and/or preferred features for each aspect of the invention are also applicable to any other aspects of the invention where appropriate.

The invention claimed is:

1. A pair of connectors comprising a first connector with a first contact and a second connector with a second contact, the connectors being configured for attachment to one another along an attachment axis, wherein:

the connectors are movable relative to one another between a first configuration and a third configuration via a second configuration;

the connectors are attached to one another in the first configuration and in the second configuration, and can only be detached from one another from the third configuration;

the contacts of the connectors are touching in the first configuration, and are not touching in the second configuration;

movement of the connectors between the first and second configurations requires the connectors to undergo a first manipulation; and movement of the connectors between the second and third configurations requires the connectors to undergo a second manipulation which is different to the first manipulation; and the connectors are movable from the first configuration to a fourth configuration, and wherein movement of the connectors between the first and fourth configurations requires the connectors to undergo a third manipulation which is different to the first manipulation, wherein the connectors are provided with respective attachment portions, wherein the attachment portion of the first connector defines a guideway and the attachment portion of the second connector defines a lug that is receivable in the guideway, and a locking section aligned in a substantially circumferential direction about the attachment axis, wherein movement of the connectors from the first configuration to the fourth configuration requires movement of the lug along the locking section.

2. A pair of connectors according to claim 1 wherein the first manipulation including relative movement of the attachment portions in a first direction and the second manipulation including relative movement of the attachment portions in a second direction which is different to the first direction.

3. A pair of connectors according to claim 2 wherein the first manipulation including movement of the lug along the guideway in a first direction and the second manipulation including movement of the lug along the guideway in a second direction.

4. A pair of connectors according to claim 3 wherein:

the guideway comprises a disconnection section, an intermediate section and a release section, each section having two ends, one end of the intermediate section intersecting an end of the disconnection section and the other end of the intermediate section intersecting an end of the release section;

movement of the connectors from the first configuration to the second configuration requires movement of the lug along the disconnection section, from the end of the disconnection section which does not intersect the intermediate section to the end of the disconnection section which does intersect the intermediate section; and movement of the connectors from the second configuration to the third configuration requires movement of the lug along the intermediate section, from the end of the intermediate section which intersects the disconnection section to the end of the intermediate section which intersects the release section.

5. A pair of connectors according to claim 4, wherein:

the locking section has two ends, an end of the locking section intersecting the end of the disconnection section which does not intersect the intermediate section;

wherein movement of the connectors from the first configuration to the fourth configuration requires movement of the lug along the locking section from the end of the locking section which intersects the disconnection section to the end of the locking section which does not intersect the disconnection section.

6. A pair of connectors according to claim 5 wherein the locking section comprises a recess, and one of the connectors comprises a resilient element arranged to urge the lug into said recess when the connectors are in the fourth configuration.

7. A pair of connectors according to claim 4 wherein the disconnection section is aligned in a direction substantially parallel to the attachment axis.

8. A pair of connectors according to claim 4 wherein the intermediate section is aligned in a substantially circumferential direction about the attachment axis.

9. A pair of connectors according to claim 4 wherein the release section is aligned in a direction substantially parallel to the attachment axis.

10. A pair of connectors according to claim 1 wherein the attachment portion of one of the connectors comprises a sleeve which is movable relative to a main body of that connector, and optionally further comprising on or more markings to indicate the position of the sleeve relative to the main body.

11. A pair of connectors according to claim 8 further comprising one or more markings arranged to indicate the position of the sleeve relative to the connector which does not comprise the sleeve.

12. A pair of connectors according to claim 3 wherein the lug extends substantially radially inwards towards the attachment axis.

13. A pair of connectors according to claim 3 wherein the attachment portion of the first connector defines two such guideways and the attachment portion of the second connector comprises two such lugs.

14. A pair of connectors according to claim 1 wherein at least one of said connectors is configured for attachment to an electrical cable.

15. A pair of connectors according to claim 1 wherein in the second configuration, the connectors co-operatively define a chamber and a flame path of a predetermined length which runs from the chamber to an external surface of at least one of the connectors, the predetermined length of the flame path conforming to British Standard BS EN 60079-1:2007.

16. A pair of connectors according to claim 1 wherein in the second configuration, the connectors are configured to resist axial separation along the attachment axis.

17. A first connector for a pair of connectors according to claim 1.

18. A second connector for a pair of connectors according to claim 1.

19. An electrical system comprising a first connector, a second connector, and/or a pair of connectors according to claim 1.

20. A pair of connectors comprising a first connector with a first contact and a second connector with a second contact, the connectors being configured for attachment to one another along an attachment axis, wherein:

the first connector has an attachment portion which defines a guideway, and the second connector has an attachment portion which defines a lug that is receivable in the guideway;

the guideway comprises a disconnection section, an intermediate section, a release section and a locking section, each section having two ends, one end of the intermediate section intersecting an end of the disconnection section and the other end of the intermediate section intersecting an end of the release section and one end of the disconnection section intersecting an end of the locking section;

the connectors are movable between a first configuration in which the lug is received in the end of the disconnection section which does not intersect the intermediate section, a second configuration in which the lug is received at the point at which the disconnection section intersects the intermediate section, a third configuration in which the lug is received at the point at which the intermediate section intersects the release section and a fourth configuration in which the lug is received within a portion of the locking section;

the contacts are touching when the connectors are in the first and fourth configurations, and are not touching when the connectors are in the second configuration;

the intermediate section is configured such that the lug can travel between the end of the intermediate section that intersects the disconnection section and the end that intersects the release section, only upon relative movement of the attachment portions of the connectors, transverse to the attachment axis, by an external force;

the locking section is configured such that the lug can travel between the end of the disconnection section that intersects the locking section and the portion of the locking section, only upon relative movement of the attachment portions of the connectors, transverse to the attachment axis, by an external force and the end of the release section which is opposite to the end that intersects the intermediate section provides a mouth through which the lug can exit the guideway.

* * * * *